US008578552B2

(12) United States Patent
Orubor

(10) Patent No.: US 8,578,552 B2
(45) Date of Patent: Nov. 12, 2013

(54) APPARATUS FOR CLEARING WASTE FROM A SURFACE

(76) Inventor: Lawrence Orubor, Calgary (CA)

( * ) Notice: Subject to any disclaimer, the term of this patent is extended or adjusted under 35 U.S.C. 154(b) by 31 days.

(21) Appl. No.: 13/363,429

(22) Filed: Feb. 1, 2012

(65) Prior Publication Data

US 2012/0192376 A1 Aug. 2, 2012

Related U.S. Application Data

(60) Provisional application No. 61/438,282, filed on Feb. 1, 2011.

(51) Int. Cl.
*A47L 9/24* (2006.01)

(52) U.S. Cl.
USPC ..... 15/320

(58) Field of Classification Search
USPC ..... 15/320–322
See application file for complete search history.

(56) References Cited

U.S. PATENT DOCUMENTS

| | | | | |
|---|---|---|---|---|
| 3,680,504 | A | 8/1972 | Seebald | |
| 4,667,364 | A * | 5/1987 | Meili | 15/320 |
| 4,957,131 | A | 9/1990 | Robinson | |
| 6,077,362 | A | 6/2000 | Reed | |
| 7,703,170 | B2 | 4/2010 | Orubor | |
| 2008/0030032 | A1 | 2/2008 | Gill | |
| 2008/0093486 | A1 | 4/2008 | Orubor | |
| 2009/0070953 | A1 * | 3/2009 | Orubor | 15/320 |

FOREIGN PATENT DOCUMENTS

| | | |
|---|---|---|
| CA | 2689384 | 12/2007 |
| CA | 2628557 | 10/2008 |
| FR | 2630141 | 10/1989 |
| WO | WO-2004/059090 | 7/2004 |
| WO | WO-2004/107947 | 12/2004 |

* cited by examiner

*Primary Examiner* — Mark Spisich
*Assistant Examiner* — Andrew A Horton
(74) *Attorney, Agent, or Firm* — Maxey Law Offices; Stephen Lewellyn

(57) ABSTRACT

An apparatus for removing waste material from a surface is provided. In an embodiment, the apparatus includes a vacuum suction head and a waste receptacle for storing waste material that are vacuumed through the suction opening head. The waste receptacle has a discharge port through which waste material stored within said waste receptacle may be discharged for emptying said waste receptacle. A fluid passage is configured at one end to be connected to a source of pressurized water by a garden hose. A first spray nozzle is connected to an end of the fluid passage and configured to jet fluid from the fluid passage in a direction away from an operator and against material on the surface.

32 Claims, 33 Drawing Sheets

APPARATUS FOR CLEARING WASTE FROM A SURFACE

CROSS-REFERENCE TO RELATED APPLICATION

This application claims the benefit of U.S. Provisional Application No. 61/438,282, filed Feb. 1, 2011, the entirety of which is incorporated herein by reference.

FIELD OF THE INVENTION

The present invention relates generally to waste material removal and collection devices, and more particularly, relating to fluid spraying and vacuum device for the treatment and removal of animal waste material from a surface.

BACKGROUND OF THE INVENTION

Animal waste, particularly raw fecal material from dogs and other household pets are smelly and consist largely of numerous disease causing pathogens that pose potential health risks to pets and humans exposed to them. These disease-causing pathogens found in fecal material also contaminate our soil, water and food grown in their vicinity. It is believed, the enormous volume of uncontrolled animal waste produced each year has significant impact on public health and the environment. Particularly, in the presence of accumulated waste in places such as backyards, public and private play grounds, including off leash parks. The presence of animal waste is considered an eye sore and a nuisance which must be eliminated.

SUMMARY OF THE INVENTION

The preferred embodiments of the present invention addresses this need by providing an apparatus for clearing waste from a surface that includes treating the waste material with a treatment solution and vacuuming the waste from the surface into a storage receptacle for later disposal at a suitable location. There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

In this description, references to "one embodiment" or "an embodiment" mean that the featuring being referred to is included in at least one embodiment of the invention. Moreover, separate references to "one embodiment" in this description do not necessarily refer to the same embodiment. Illustrated embodiments are not mutually exclusive, unless so stated and except as will be readily apparent to those of ordinary skill in the art. Thus, the invention may include any variety of combinations and/or integrations of the embodiments described herein.

Figure 1:
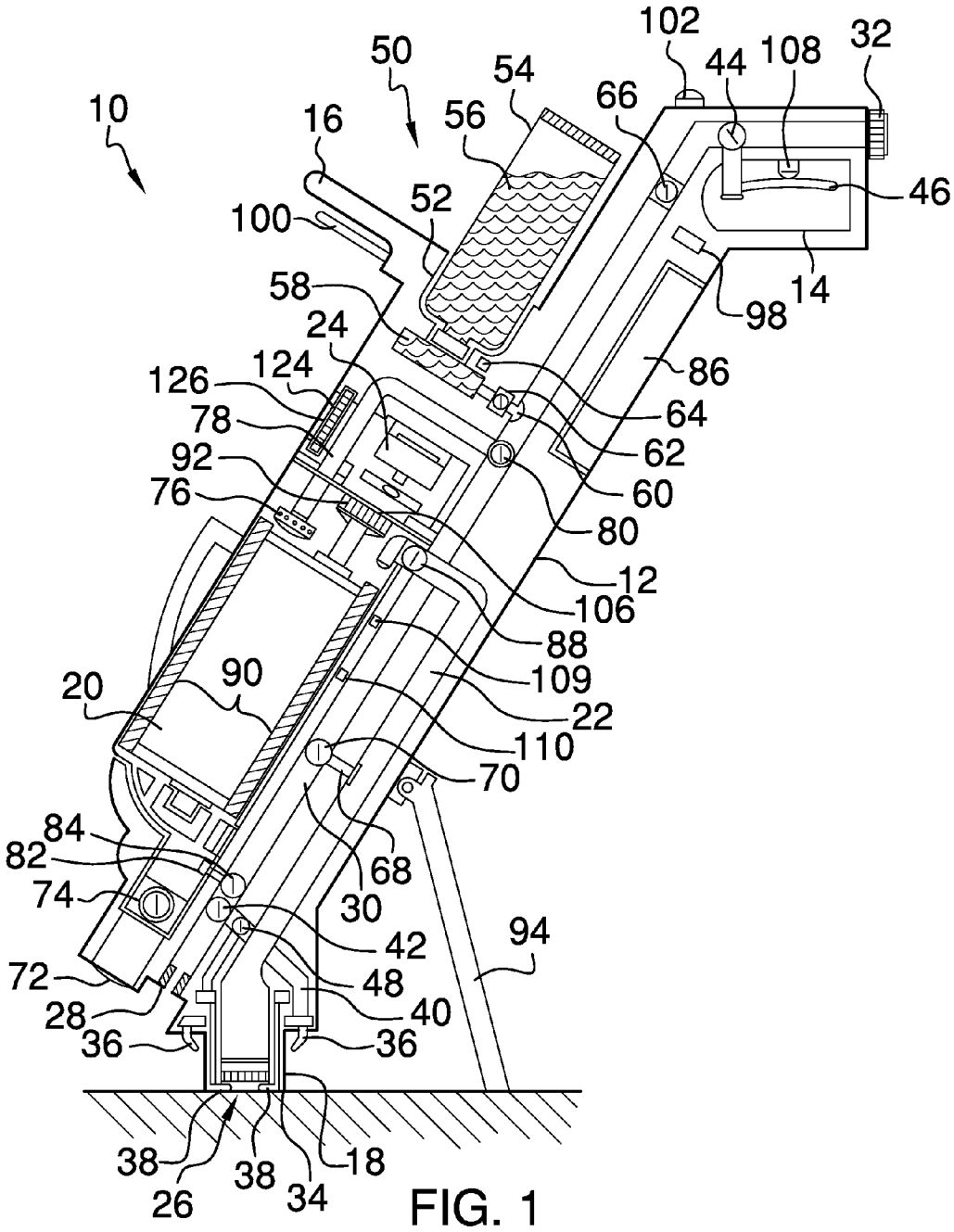
FIG. 1 is a diagrammatic view of an apparatus for clearing waste material from a surface constructed in accordance with the principles of the present invention.

In FIG. 1, there is illustrated a first embodiment of an apparatus for clearing waste from a surface 10 of the present invention. Apparatus 10 provides an operator with a combination of fluid spraying and waste material suction and storage that is particularly useful in clearing a surface, such as a walk way from animal waste or the like. Apparatus 10 is essentially a self-cleaning and self-flushing vacuum cleaning device for the collection, treatment and evacuation of waste material, such as, for an example animal waste that has been deposited on a surface.

Apparatus 10 includes a hand held body or boom 12 having a rearward control handle 14 and a forward control handle 16. An operator grasps the rearward and forward control handles 14 and 16 to position and operate the apparatus 10.

Boom 12 includes a vacuum suction head 18 that is disposed at an opposite end of the boom from the rearward control handle 14. The vacuum suction head 18 has an opening 26 that is connected to a vacuum collection and storage receptacle 20 via vacuum passage 22. A protective grille 34 may be positioned across the opening 26 to prevent large debris from entering vacuum passage 22 that could result in clogging thereof. The receptacle 20 is carried by the boom 12 and may be integrally formed therewith, or alternatively, the receptacle may be removably attached to the boom to facilitate cleaning as will be described in further detail below. A vacuum motor 24 is housed by the boom 12. Boom 12 is configured such that operation of the vacuum motor 24 creates a vacuum in the receptacle 20 drawing air and material through the opening 26 of the vacuum suction head 18 and into the receptacle. The air is then discharged through an odor-absorbing filter 124 that prevents the discharge of malodors from the device during operation. The odor absorbing filter 124 is disposed across vacuum motor air exit 126 and is received by the boom 12 in a cooperating manner which does not require any tools for the removal and replacement of the filter. A vacuum passage valve 88 is disposed across the vacuum passage 22 and is operated to permit the vacuuming of material into the receptacle 20 and then operated to prevent the reverse flow of material from the receptacle through the vacuum passage. As also will be described in further detail below, in an alternative embodiment, the boom 12 and the vacuum motor 24 may be configured such that operation of the vacuum motor results in air discharged through opening 26 of the vacuum section head 18.

Apparatus 10 further includes an exterior fluid spray nozzle 28 disposed on boom 12 and adjacent to the vacuum section head 18. The exterior fluid spray nozzle 28 is connected to fluid passage 30 that is connectable to an external fluid carrying hose (not shown here) by a hose coupling 32 to receive a source of pressurized fluid, such as water from a hose spigot. Fluid spray nozzle 28 is configured to jet fluid from the fluid passage 30 in a controlled manner and in a direction away from the operator against material on a surface, such as for example, a walkway to breakup, dislodge and/or flush the surface free of the material. A main control valve 44 is disposed across fluid passage 30 and is connected to a trigger 46 approximate handle 14. The main control valve 44 is a normal closed valve and is operated to an open position by an operator squeezing trigger 46 to permit the flow of water from a hose connected to hose coupling 32 to flow through the fluid passage 30.

In addition to the exterior fluid spray nozzle 28, the suction head 18 may include fluid spray nozzles 36 and 38 that are connected to the fluid passage 30, for example via fluid passage 40. A spray nozzle selector valve 42 connects fluid passage 40 and fluid passage 38 and is operable to selectively permit the flow of fluid in fluid passage 30 through nozzle 28 or nozzles 36 and 38. Spray nozzle selector valve 42 may be an electrically operated valve. Nozzles 36 may be disposed and configured to direct a fluid spray on the exterior surface of the suction head 18 to remove debris therefrom. Nozzles 38 may be disposed and configured to direct a fluid spray at opening 26 to breakup and dislodge material on a surface to be vacuumed. A secondary spray nozzle selector valve 48 may be disposed across fluid passage 40 and operable to selectively provide a flow of fluid to either nozzles 36 or nozzles 38 or collectively to both nozzles 36 and nozzles 38. The secondary spray nozzle selector valve 48 may be an electrically operated valve.

Apparatus 10 further includes a chemical dispenser 50 configured to selectively discharge a chemical concentrate solution into the flow of fluid through fluid passage 30 to be admixed therewith and dispensed. The chemical dispenser 50 includes a cradle 52 disposed on boom 12 and configured to removable receive and retain a container 54 containing therein a quantity of chemical concentrate solution 56. Of course, chemical solution 56 need not be a concentrated solution. Further, chemical solution 56 may be a solution having anti-bacterial properties, odor neutralizing properties, etc. A fluid accumulator 58 is fluidically connected to the container 54 to receive therein the chemical solution 56 when the cradle 52 receives the container 54. The container 54 may be fitted with a membrane seal that is pierced by a tube extending from the accumulator 58 to fluidically connect the container and accumulator. Alternatively, a cooperative valve system could be used to fluidically connect the container 54 and the fluid accumulator 58 while preventing spilling of the chemical solution 56 from the container during insertion and removal of the container from the cradle. Essentially, chemical solution 56 within the container 54 flows under the force of gravity into the fluid accumulator 58 when the container is received by the cradle 52 to provide a continuous supply of chemical solution from the container to the accumulator. When the container becomes empty the container is replaced with a full container.

A siphon tube 60 extends from the accumulator 58 and connects to the fluid passage 30 such that fluid flowing through fluid passage 30 and across the siphon tube draws chemical solution 56 within the fluid accumulator into the fluid passage 30 where it is admix with the fluid flowing therethrough. A chemical supply valve 62 is disposed across the siphon tube 60 or between the accumulator 58 and fluid passage 30 and is operated to control the flow of chemical solution 56 from the accumulator 58 into the fluid passage 30. The chemical supply valve 62 may be an electrically operated valve.

In an embodiment, the apparatus 10 may include a fluid sensor 64 to detect the presence of chemical solution 56 within the accumulator 58. Further, an electrically operated cut-off valve 66 may be disposed across the fluid passage 30 at a position immediately down stream of the main supply valve 44. Cut-off 66 is operated to permit the flow of fluid through passage 30 when the fluid sensor 64 detects the presence chemical solution 56 within the accumulator and is operated to prevent the flow of fluid through passage 30 when the fluid sensor does not detect chemical solution within the accumulator. In an aspect, fluid sensor 64 may be operably connected to the power supply and/or the electrical components of the apparatus 10 to prevent the supply of electrical power from the power supply to the electrical components when the fluid sensor does not detect the presence of chemical solution within the accumulator.

In an embodiment, the apparatus 10 may include a vacuum passage spray nozzle 68 disposed and configured to spray fluid from fluid passage 30 into the vacuum passage 22 at a position between the suction head 18 and the collection receptacle 20 to further subject or treat material flowing through the vacuum passage. Vacuum passage spray nozzle 68 is connected to fluid passage 30 by vacuum passage spray nozzle valve 70. Vacuum passage spray nozzle valve 70 may be an electrically operated valve.

In an embodiment, the vacuum collection and storage receptacle 20 may include a discharge port 72 that is configured to permit the discharge of the contents of the receptacle 20. A discharge valve 74 is disposed across the discharge port 72 and is selectively operated to open and close the discharge port. Discharge valve 74 may be an electrically operated valve. Further, the apparatus 10 may include a spray head 76 configured to spray fluid within the vacuum collection and storage receptacle 20 to flush the interior thereof. The spray head 76 is connected to a spray head fluid passage 78 that is connected to the fluid passage 30 by a spray head valve 80. Spray head valve 80 is selectively operable to permit the flow of fluid in passage 30 through the spray head 76 and into the receptacle 20. Spray head valve 80 may be an electrically operated valve. Further, apparatus 10 may include a discharge port spray nozzle 82 disposed and configured to spray fluid from fluid passage 30 into the discharge port 72 to further subject or treat material flowing through the discharge port. Discharge port spray nozzle 82 is connected to fluid passage 30 by discharge port spray nozzle valve 84. Discharge port spray nozzle valve 84 may be an electrically operated valve.

Figure 2:
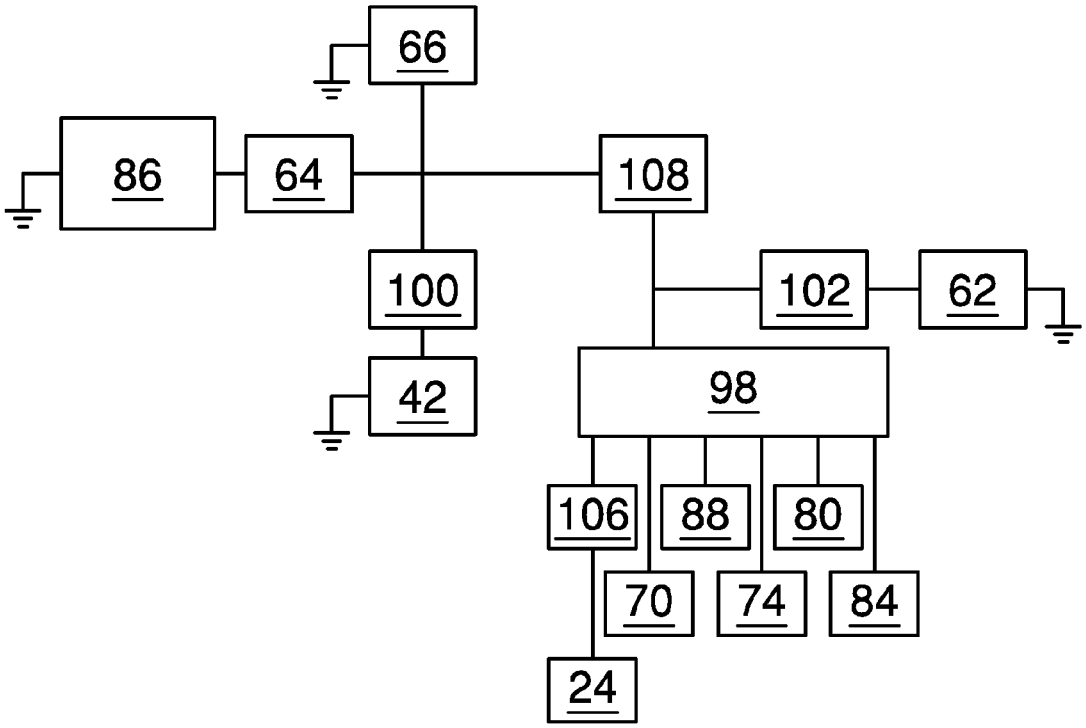
FIG. 2 is an exemplarily block diagram of an electrical schematic of the apparatus of FIG. 1.

Apparatus 10 includes a power supply 86 carried by the boom 12 that may be removed to permit replacement or recharging. Power supply 86 provides electrical power to the various electrically operated components of the apparatus 10. A block diagram of an exemplary electrical schematic of the apparatus 10 is illustrated in FIG. 2. Alternatively, the power supply could be provided by an electrical cord connected to a standard house hold electrical receptacle.

In an embodiment, one or more wiper or squeegee blades 90 may be disposed within the vacuum receptacle 20 and rotatably supported therein with the blades in contact with the interior vertical surface for rotation about an axis, whereby rotation of the blades 90 causes them to sweep across the interior vertical surface and wipe the surface clean, much like a windshield wiper of a vehicle. The blades 90 may be operatively connected to a turbine 92 that is disposed within the air flow of the vacuum motor 24 and which drives the blades 90 by air flowing across or through the turbine during operation of the vacuum motor 24.

Apparatus 10 may further include a stand 94 that is pivotally attached to the boom 12 for rotation between a stored position where the stand is refracted against the boom and a support position where the stand is expanded away from the boom and provides a support upon which the apparatus may rest.

In the following description several modes of operation of the apparatus 10 will be discussed. In each of these modes of operation, and in embodiments including the fluid sensor 64, it is presumed there is a quantity of chemical solution 56 within fluid accumulator 58 and the fluid sensor is operating to detect the chemical solution and to permit the supply of electrical power to the various electrical components of the apparatus.

Figure 3:
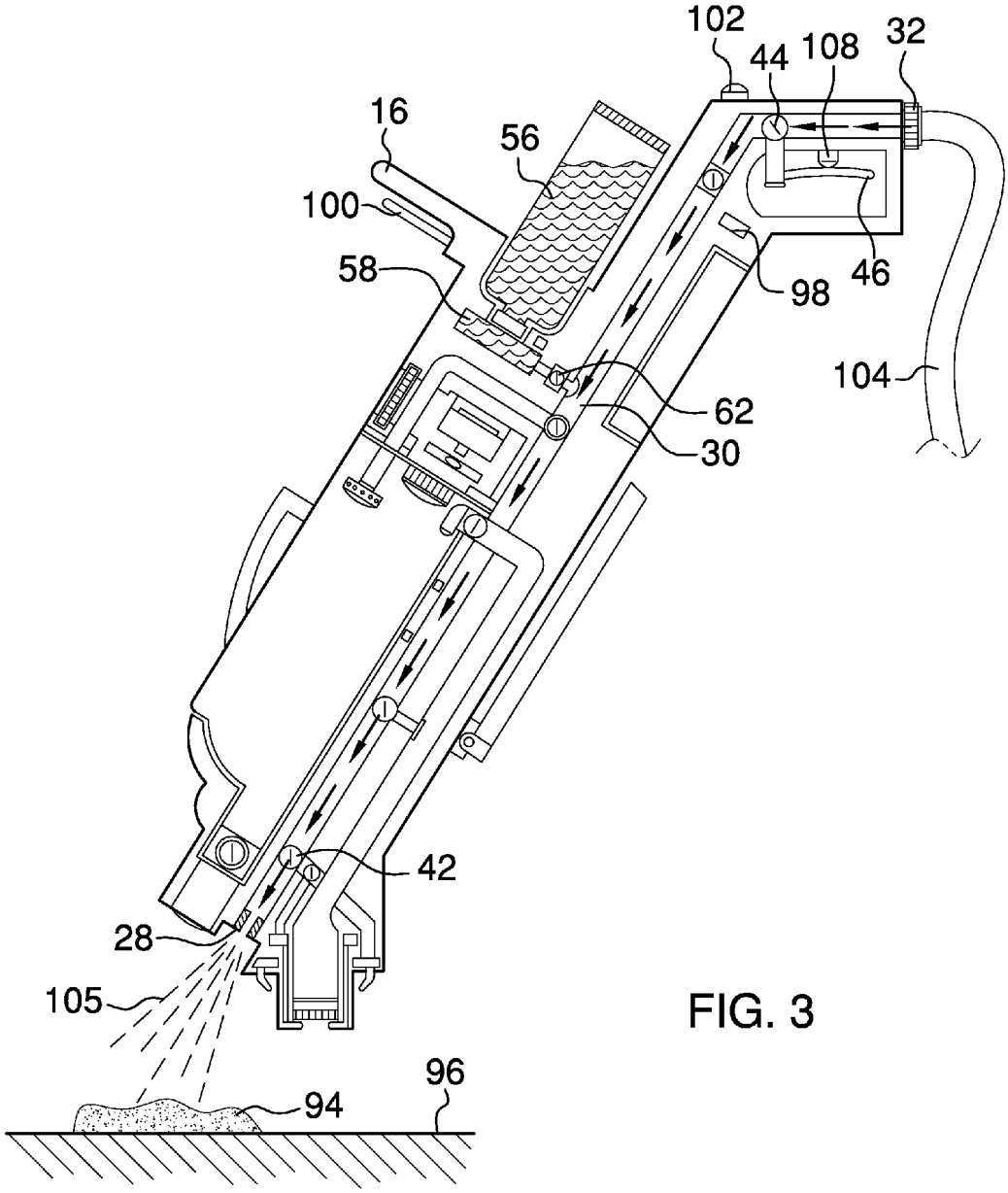
FIG. 3 is a diagrammatic view of the apparatus of FIG. 1 illustrating the apparatus in a mode of operation where an external spray of fluid is directed at waste material deposited on a ground surface.

FIG. 3 is a diagrammatic illustration of the apparatus 10 operating in one mode of operation where a jet of water or chemical solution admixed with water is directed towards waste material 94 on a ground surface 96, such as, for example, a walk way. Here, operating mode selector switch 98 is selected to permit operation of spray nozzle selector valve 42 upon activation of auxiliary trigger switch 100 and operation of chemical supply valve 62 upon activation of chemical supply switch 102. A hose 104, such as a garden hose is connected to hose coupling 32 and provides a source of water under pressure to fluid passage 30. An operator, grasping rearward control handle 14, squeezes trigger 46 operating main control valve 44 into the open position and establishing a flow of water within the fluid passage 30. The operator, grasping the forward control handle 16, squeezes auxiliary trigger switch 100 to operate spray nozzle selector valve 42, thereby establishing fluid flow between the fluid passage 30 and the exterior spray nozzle 28 and resulting in a jet of water 105 being dispensed and directed towards the waste material 94. If desired, the operator may activate chemical supply switch 102 to operate chemical supply valve 62 into the open position to permit the flow of chemical solution 56 from the accumulator 58 into the fluid passage 30 where it is admixed with the flow of water therethrough and dispensed by exterior spray nozzle 28.

Figure 4:
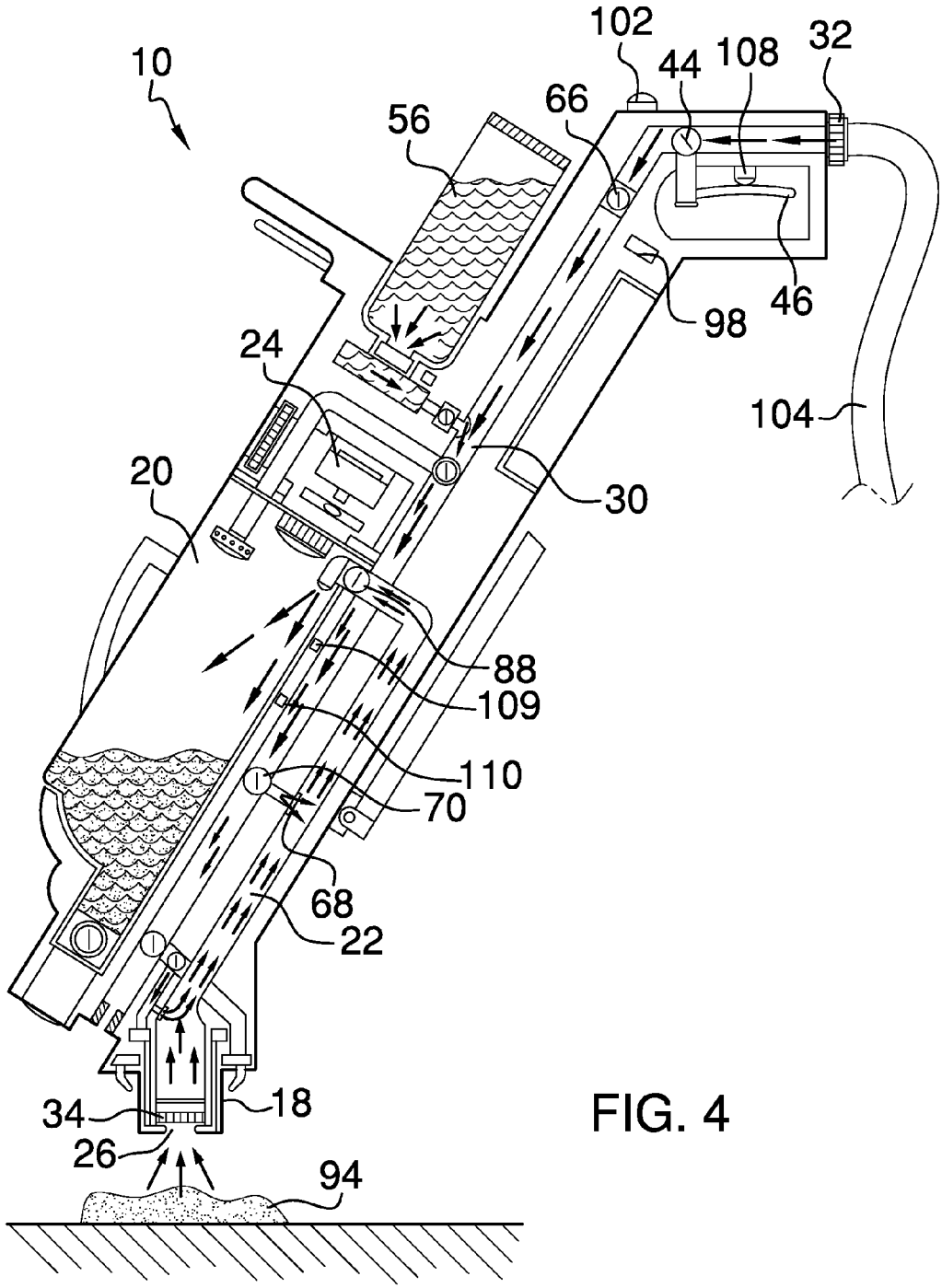
FIG. 4 is a diagrammatic view of the apparatus of FIG. 1 illustrating the apparatus in another mode of operation where waste material is being vacuumed from a ground surface and treated with fluid as it is vacuumed into the apparatus.

FIG. 4 is a diagrammatic illustration of the apparatus 10 operating in another mode of operation where waste material 94 is being vacuumed and treated with chemical solution 56 during vacuuming into the vacuum receptacle 20. Here, operating mode selector switch 98 is selected to permit operation of the vacuum passage valve 88, the vacuum passage spray nozzle valve 70, the chemical supply valve 62, the blow motor 24 (in vacuum mode) and air duct valve 106 upon operation the main electrical switch 108, such as, for example, by the operator squeezing trigger 46 during operation of main control valve 44. A hose 104, such as a garden hose is connected to hose coupling 32 and provides a source of water under pressure to fluid passage 30. An operator, grasping rearward control handle 14, squeezes trigger 46 operating main control valve 44 into the open position and establishing a flow of water within the fluid passage 30 and further operates main electrical switch 108. Upon activation of main electrical switch 108, the blow motor 24 is started, the air duct valve 106 is opened and the vacuum passage valve 88 is opened, thereby creating a suction force at opening 26 at the suction head 18.

Further, upon activation of main electrical switch 108, the chemical supply valve 62 is opened thereby establishing a flow of chemical solution 56 into the fluid passage 30 where it is admixed with the water flowing therethrough. The admixed chemical solution is dispensed by spray nozzles 38 towards waste material 94 as it is vacuumed through opening 26 and into the vacuum passage 22. Additionally, upon activation of the main electrical switch 108, vacuum passage spray nozzle valve 70 is operated to establish a flow of admixed chemical solution to the vacuum passage spray nozzle 68 for dispensing admixed chemical solution within the vacuum passage 20 to both lubricate the passage and to further treat waste material 94 flowing through the vacuum passage. Apparatus 10 then operates to vacuum and treat waste material that is positioned approximate the suction head 18, thereby removing the waste material from the surface.

An optional agitator and/or rotatable blade located above or below the protective grill 34, could be operated to aid in breaking up waste.

Once the operator releases trigger 46 complete operation of the apparatus 10 is stopped, and thus the air duct valve 106 and the vacuum passage valve 88 are closed, thereby trapping all vacuumed material disposed within the vacuum receptacle 20.

In embodiments, the apparatus 10 may include waste material level sensors 109 and 110 spaced along the vacuum receptacle at different levels of volume. The waste material level sensors 109 and 110 operate to sense the level of waste material collected within the vacuum receptacle 20. In one aspect, during waste material vacuuming as illustrated in FIG. 3 and discussed above, the apparatus 10 may operate such that the apparatus automatically turns off the blow motor 24, closes vacuum passage valve 88 and air duct valve 106 as a function of the waste material level sensor 109 detecting a high level of waste material collected within the vacuum receptacle, and thus preventing overfilling thereof.

Figure 5:
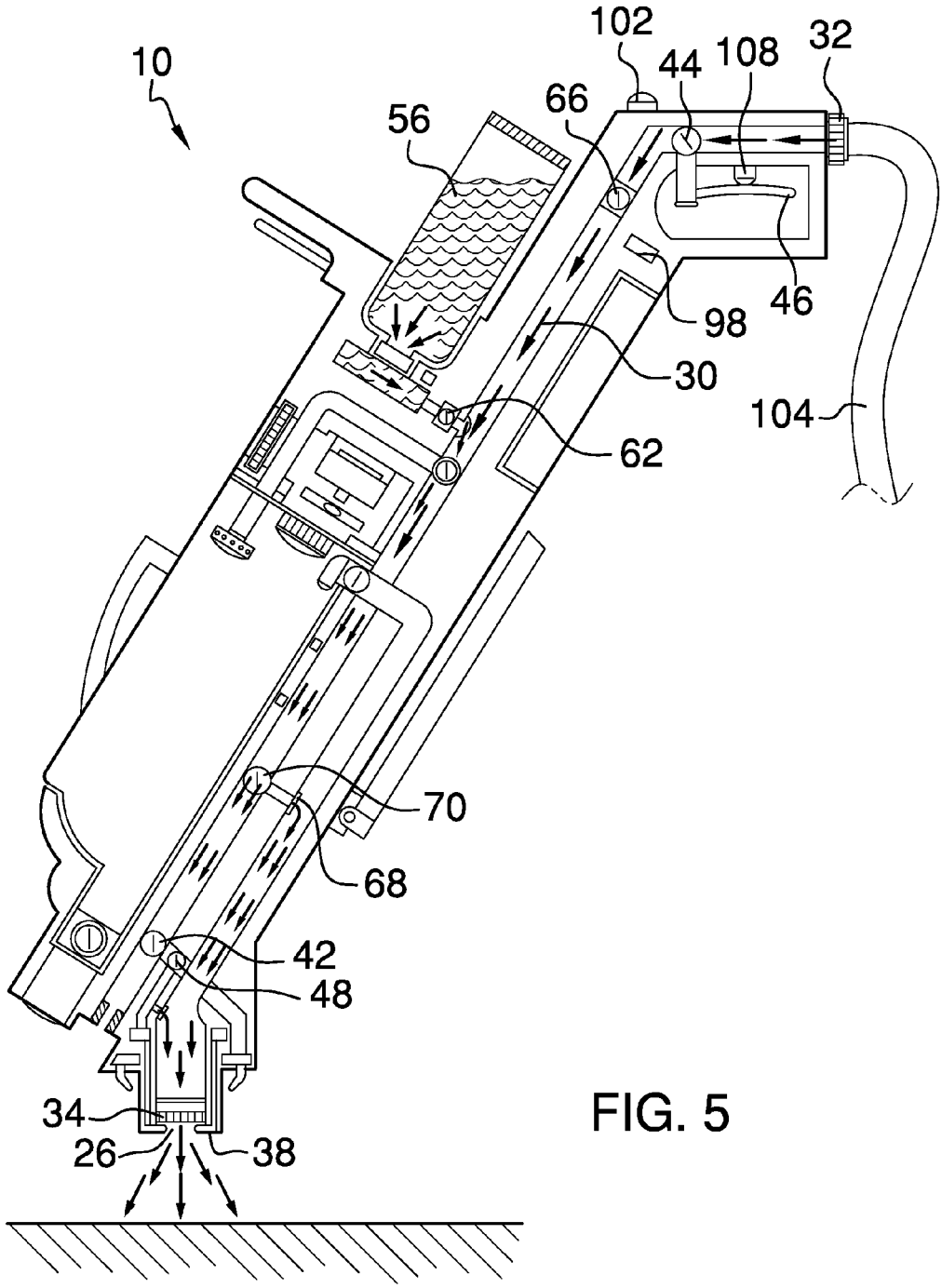
FIG. 5 is a diagrammatic view of the apparatus of FIG. 1 illustrating the apparatus in another mode of operation where debris that became trapped during vacuuming is being dislodged.

During vacuuming, larger debris may get lodged or trapped within opening 26 and/or by the protective grille 34. Accordingly, the apparatus 10 may be operated in another mode of operation wherein trapped debris may be flushed from the opening 26 and/or protective grille 34. FIG. 5 is a diagrammatic illustration of the apparatus 10 operating to flush debris caught in the opening 26 and/or protective grille 34. Here, operating mode selector switch 98 is selected to permit operation of the vacuum passage spray nozzle valve 70 and upon operation the main electrical switch 108, such as, for example, by the operator squeezing trigger 46 during operation of main control valve 44. Further, spray nozzle selector valve 42 and spray nozzle selector valve 48 are operated to establish fluid flow from the fluid passage 30 to spray nozzles 38. A hose 104, such as a garden hose is connected to hose coupling 32 and provides a source of water under pressure to fluid passage 30. An operator, grasping rearward control handle 14, squeezes trigger 46 operating main control valve 44 into the open position and establishing a flow of water within the fluid passage 30 and further operates main electrical switch 108. Upon activation of main electrical switch 108, the vacuum passage spray nozzle valve 70 is operated to establish a flow of water to the vacuum passage spray nozzle 68 for backing flushing the vacuum passage 20 through opening 26. Additionally, water is dispensed by spray nozzles 38 to further free debris and back flush the opening 26. If desired, the operator may activate the chemical supply switch 102 to admix chemical solution 56 with the water to treat the material being back flushed from the opening 26 and/or protective grille 34.

Figure 6:
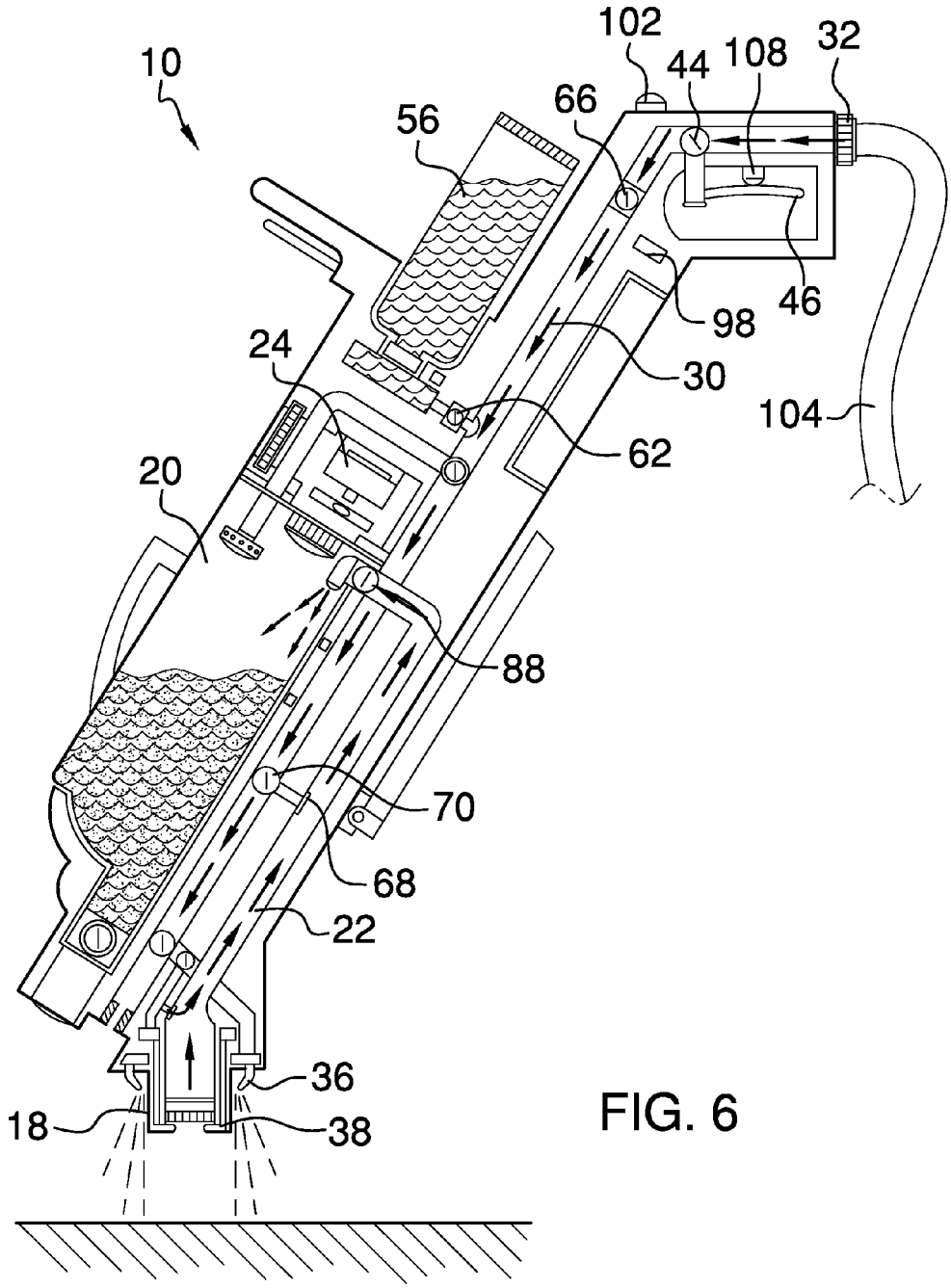
FIG. 6 is a diagrammatic view of the apparatus of FIG. 1 illustrating the apparatus in another mode of operation where the vacuum suction head and related passage is being cleaned during a self-cleaning operation.

FIG. 6 is a diagrammatic illustration of the apparatus 10 operating in another mode of operation, a self-clean mode, where the vacuum passage 22 and the suction head 18 is cleaned. Here, operating mode selector switch 98 is selected to permit operation of the vacuum passage valve 88, the vacuum passage spray nozzle valve 70, the blow motor 24 (in vacuum mode) and air duct valve 106 upon operation the main electrical switch 108, such as, for example, by the operator squeezing trigger 46 during operation of main control valve 44. A hose 104, such as a garden hose is connected to hose coupling 32 and provides a source of water under pressure to fluid passage 30. An operator, grasping rearward control handle 14, squeezes trigger 46 operating main control valve 44 into the open position and establishing a flow of water within the fluid passage 30 and further operates main electrical switch 108.

Upon activation of main electrical switch 108, the blower motor 24 is started, the air duct valve 106 is opened and the vacuum passage valve 88 is opened, thereby creating a suction force at opening 26 at the suction head 18. Additionally, upon activation of the main electrical switch 108, vacuum passage spray nozzle valve 70 is operated to establish a flow of water to the vacuum passage spray nozzle 68 for dispensing within the vacuum passage 20 to aid in flushing the vacuum passage. Additionally, water is dispensed by spray nozzles 36 and 38 to further clean debris from the interior and exterior of the suction head 18. If desired, the operator may activate the chemical supply switch 102 to admix chemical solution 56. The flushing water or admix chemical solution along with any debris flushed from the suction head or vacuum passage is vacuumed into the vacuum receptacle 20.

Figure 7:
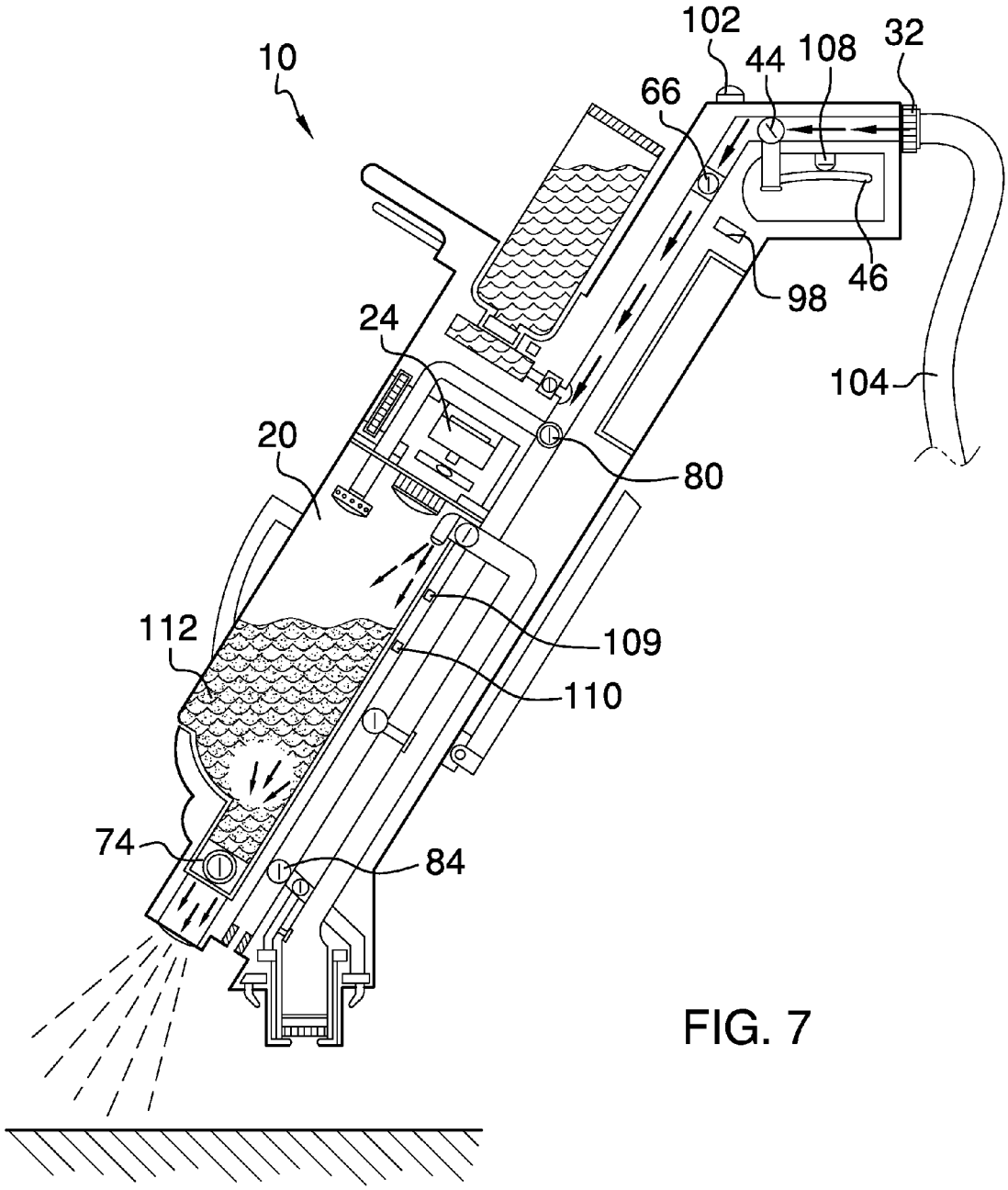
FIG. 7 is a diagrammatic view of the apparatus of FIG. 1 illustrating the apparatus in another mode of operation where the contents of the vacuum receptacle are being discarded in an initial evacuation operation.
Figure 8:
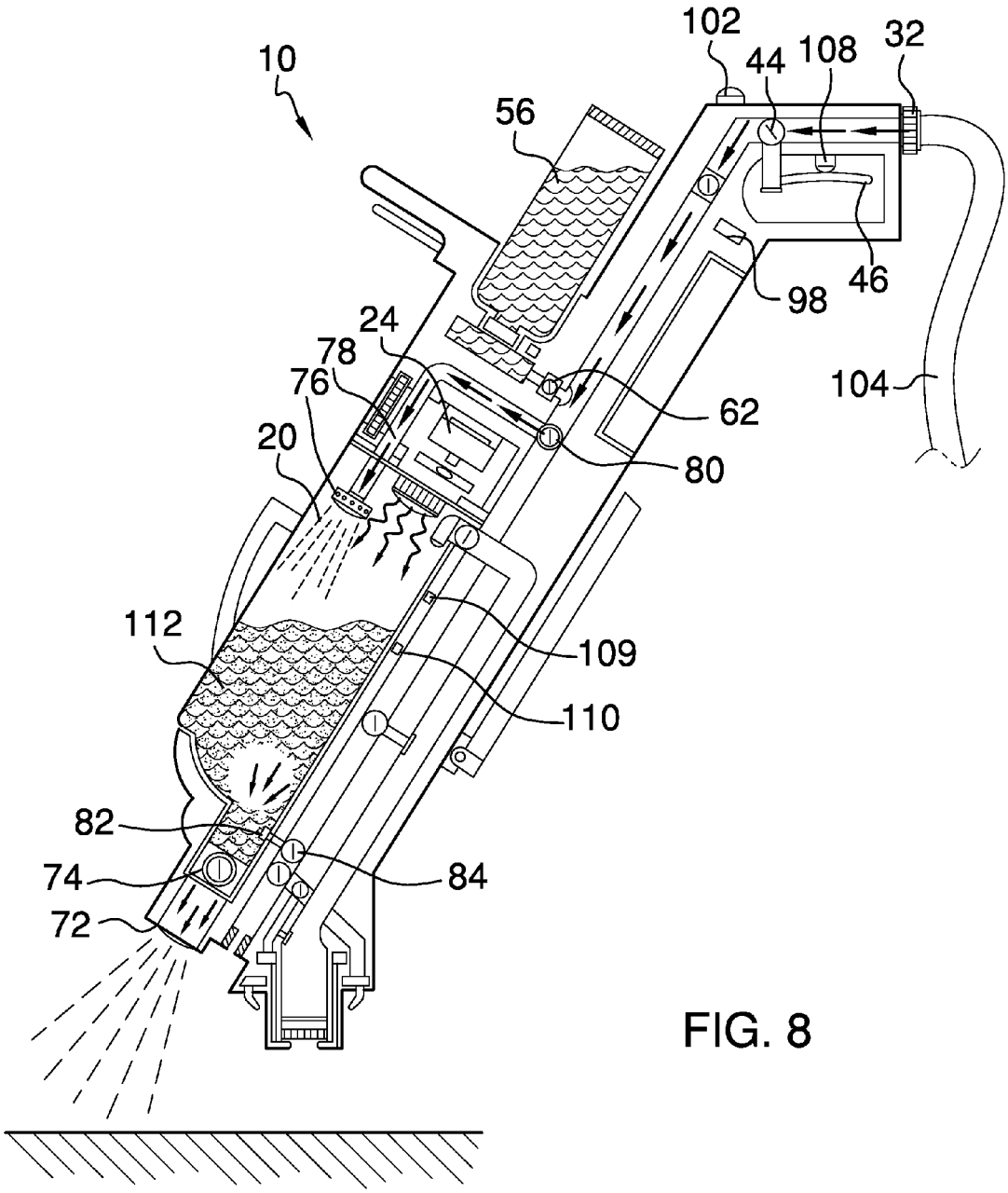
FIG. 8 is a diagrammatic view of the apparatus of FIG. 1 illustrating the apparatus in the same mode of operation as in FIG. 7 in a second evacuation operation.

With the waste material and flushing fluid collected and safely stored within the vacuum receptacle 20, the operator may carry the apparatus 10 to a desired and suitable location for disposal of the collected material. FIGS. 7 and 8 are diagrammatic illustrations of the apparatus 10 operating in another mode of operation, an evacuation mode, where the contents of the vacuum receptacle 20 are emptied therefrom and the receptacle is flushed clean. Here, the operating mode selector switch 98 is selected to permit operation of the spray head valve 80, the blower motor 24 (in a reverse mode), the discharge port valve 74, the air duct valve 106 and discharge port spray nozzle valve 84.

Initially, should have a quantity of material that was vacuumed into the vacuum receptacle 20 sufficient enough for the waste material level sensors 109 to trigger an automatic shutdown of the apparatus 10, the initial operation of the apparatus 10 in this operation mode is to simply open the discharge port valve 74 to begin the evacuation of the collected material 112 from the receptacle to provide a sufficient space within the receptacle to permit the introduction of flushing water or water admix with chemical solution as shown in FIG. 7. Waste material level sensor 110 operates to determine when a sufficient amount of the contents of the vacuum receptacle 20 has been discharged, and thus permits subsequent operation of the spray head valve 80, the blower motor 24 (in a reverse mode), the air duct valve 106 and discharge port spray nozzle valve 84 as illustrated in FIG. 8.

With reference to FIG. 8, as with prior modes of operation, a hose 104, such as a garden hose is connected to hose coupling 32 and provides a source of water under pressure to fluid passage 30. An operator, grasping rearward control handle 14, squeezes trigger 46 operating main control valve 44 into the open position and establishing a flow of water within the fluid passage 30 and further operates main electrical switch 108. The spray head valve 80 is operated into an open position and thus diverting the flow of water through fluid passage 30 into spray head fluid passage 78 wherein it is dispensed through spray head 76 and into the vacuum receptacle. Spray head 76 may be a rotating spray head. If desired, the operator may activate the chemical supply switch 102 to admix chemical solution 56. Further, the blower motor 24 is operated to create a positive pressure within the vacuum receptacle 20 to further evacuate the receptacle from its contents. Additionally, the discharge port spray nozzle valve 84 is operated to connect the discharge port spray nozzle 82 to the fluid passage 30 to dispense fluid flowing therethrough into the discharge of the vacuum receptacle 20.

Figure 9:
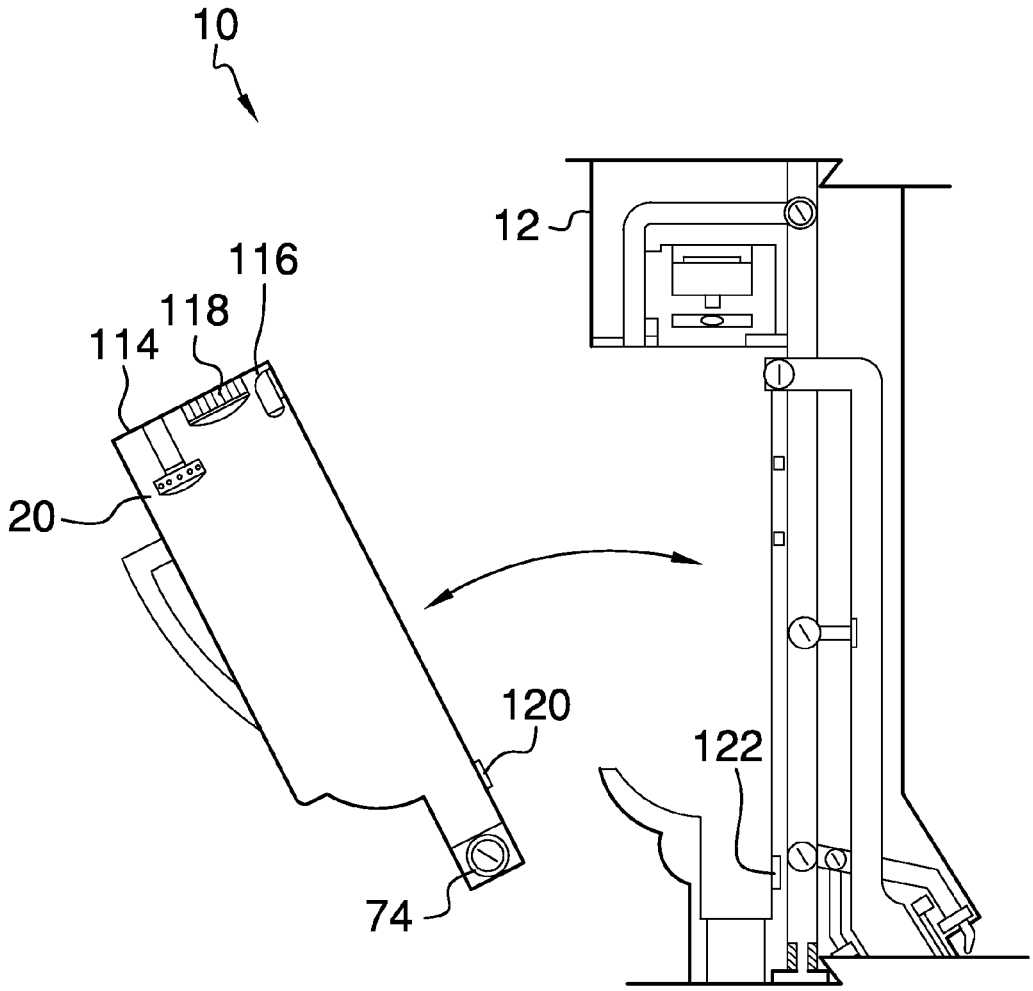
FIG. 9 is a partial diagrammatic view of the apparatus of FIG. 1 illustrating the vacuum receptacle removed.

FIG. 9 is a partial diagrammatic illustration of the apparatus 10 with the vacuum receptacle 20 removed from the boom 12. As shown, the receptacle 20 and the boom 12 have cooperating structure that permits the secure attachment of the receptacle to the boom and which permits removal of the receptacle from the boom. Receptacle 20 may be removed from the boom 12 to permit manual dumping and cleaning of the receptacle as an alternative to the automated operation discussed above. Because the collected waste material has been treated with the chemical solution, health hazards to an operator are reduced and offensive odors have been neutralized, and thus permitting manual disposal of the waste material that otherwise would present health risk. The vacuum receptacle 20 includes a vacuum receptacle cover 114 that is removably engagable with the receptacle to close vacuum receptacle opening 116. A seal 118 is disposed on the 116 cover to provide sealing contact between the boom 12 and the vacuum receptacle 20. Electrical plug 120 is received by electrical receptacle 122 on the boom to establish an electrical connection to the discharge valve 74 for operation thereof when the receptacle is attached to the boom.

Figure 10:
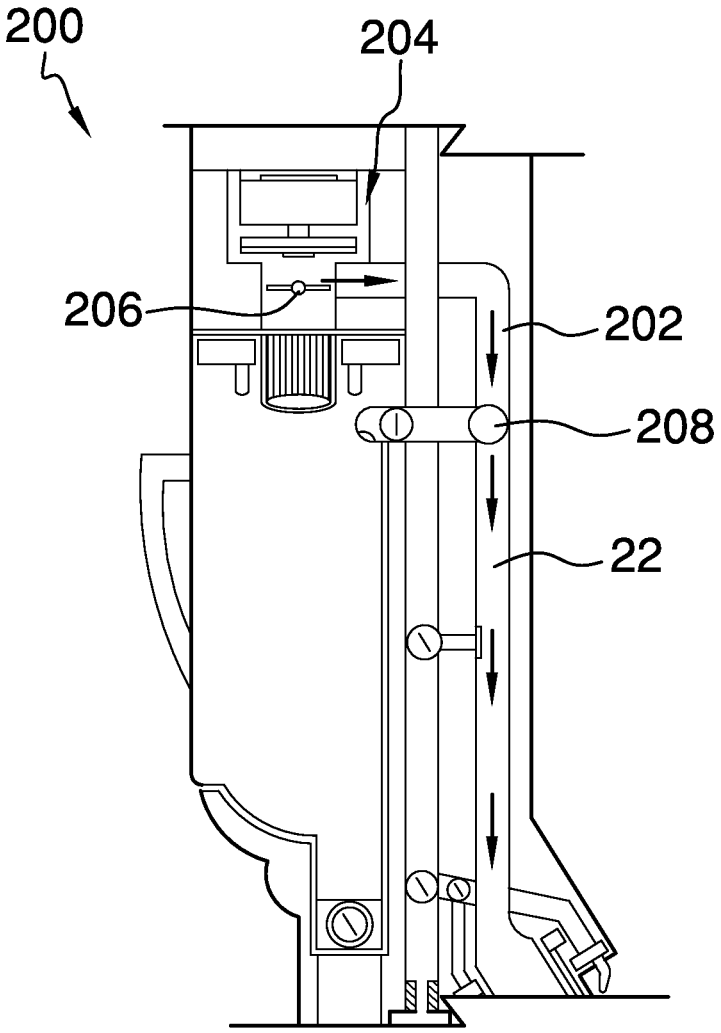
FIG. 10 is a partial diagrammatic view of an alternative construction of the apparatus.

Alternative embodiments of the apparatus 10 are possible. In FIG. 10, there is a partial diagrammatic illustration of an alternative embodiment 200 of the invention, wherein the same reference numbers refer to similar parts. Here, the vacuum passage 22 includes an extension portion 202 that connects to the blower motor housing 204. A diverter valve 206 is disposed and operable to either direct air flow produced by operating the blower motor 24 through the extension portion 202 of the vacuum passage 22 or into the vacuum receptacle 20. A second vacuum passage air valve 208 connects the extension portion 202 and the vacuum passage 22 and is operable to selectively permit air flow from the extension portion into the vacuum passage 22 or to preclude air flow between the vacuum passage and the extension portion. The advantage of this arrangement permits the operator to direct a higher volume of air through the vacuum passage 22 in a back flush mode to dislodge material captured by the protective grille 34 and/or opening 26.

Figure 11:
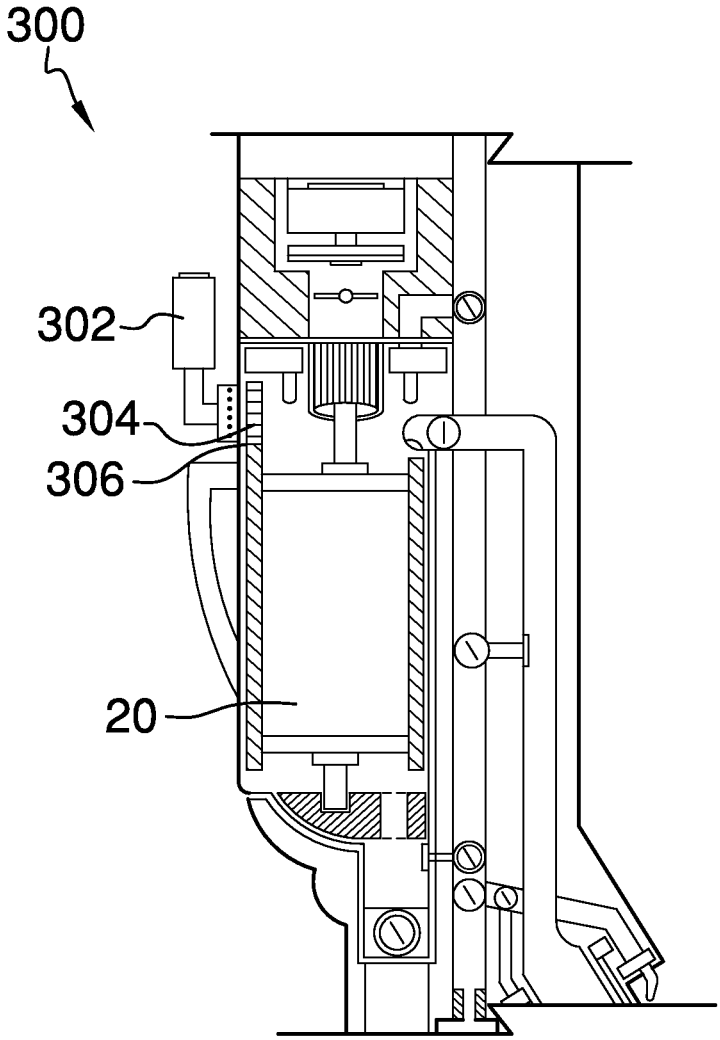
FIG. 11 is a partial diagrammatic view of an alternative construction of the apparatus.

In FIG. 11, there is a partial diagrammatic illustration of an alternative embodiment 300 of the invention, wherein the same reference numbers refer to similar parts. In embodiment 10, a turbine 92 is operatively connected to the squeegee blades 90 to rotatingly drive the squeegee blades to wipe the interior surface of the vacuum receptacle 20. In apparatus 300, the turbine 92 is eliminated and is replaced with a manual drive including a handle 302 that is disposed exteriorly of the vacuum receptacle 20 and is connected to a gear assembly disposed interiorly of the vacuum receptacle. The gear assembly includes a pinion gear 304 conjoined with the handle 302 such that rotating the handle results in a rotation in the pinion gear. The pinion gear 304 is in meshing contact with a rack 306 that is joined to the blades 90. To this end, an operator rotating handle 302 results in rotation of the blades 90 which are supported at opposite ends for rotation within the vacuum receptacle 20.

Figure 12:
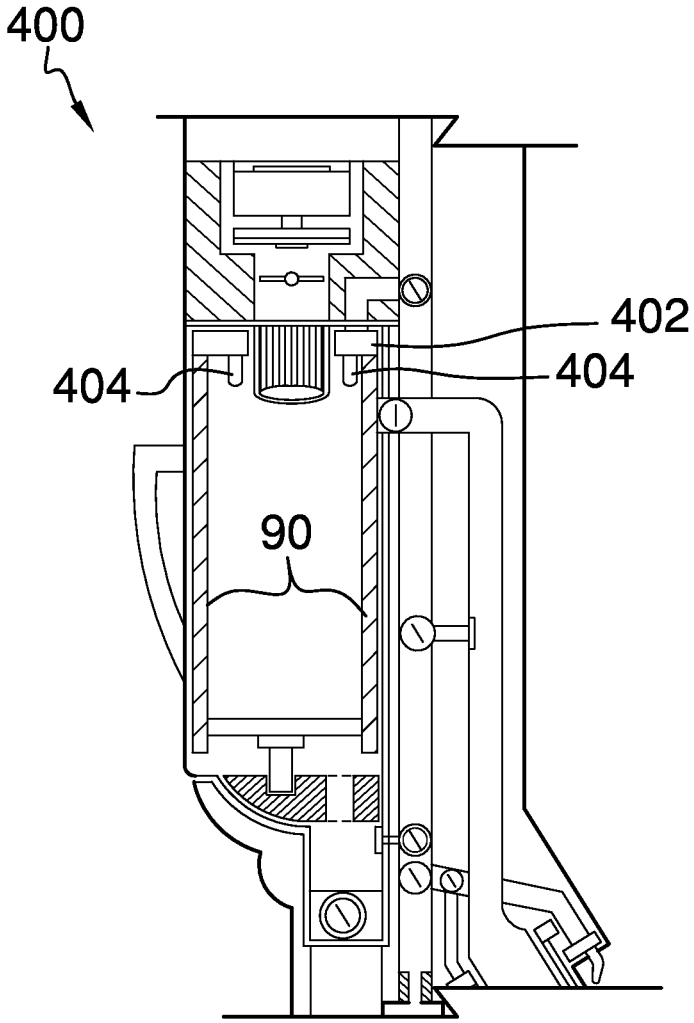
FIG. 12 is a partial diagrammatic view of an alternative construction of the apparatus.

In FIG. 12, there is a partial diagrammatic view of an alternative embodiment 400 of the invention, wherein the same reference numbers refer to similar parts. Similar to apparatus 300 discussed above, the turbine 92 is eliminated and replaced with a hydro-turbine 402 that is operatively connected to the blades 90 to rotating drive the blades within the vacuum receptacle. The hydro-turbine 402 is powered by a flow of fluid across the turbine, such as the apparatus 400 is operated to dispense fluid from nozzles 404, which replace the spray head 76.

Figure 13:
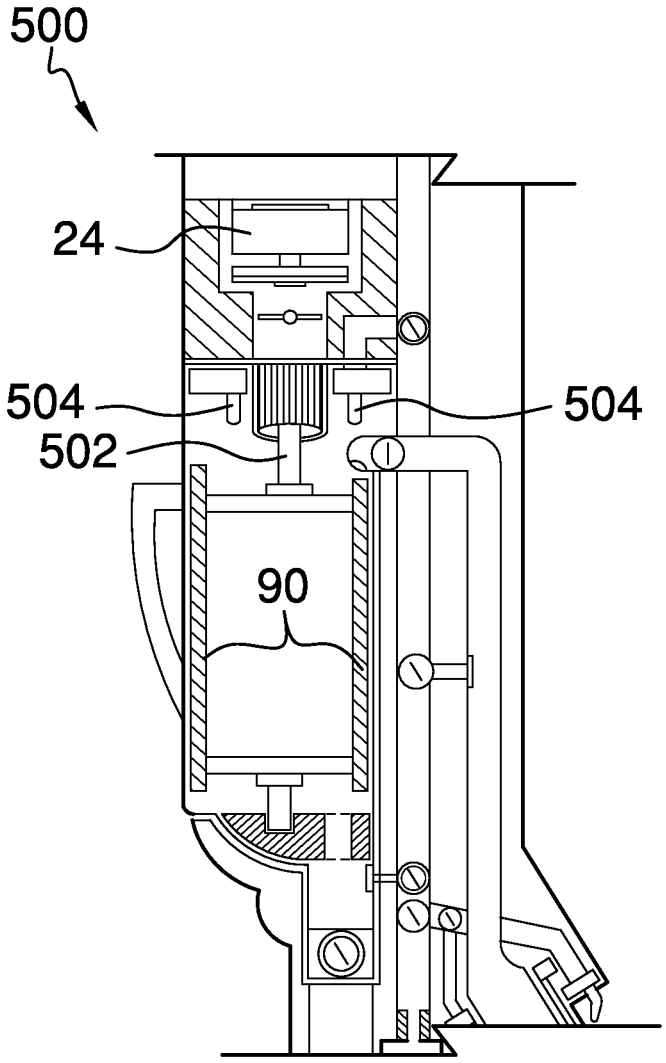
FIG. 13 is a partial diagrammatic view of an alternative construction of the apparatus.

In FIG. 13, there is a partial diagrammatic view of an alternative embodiment 500 of the invention, wherein the same reference numbers refer to similar parts. Similar to apparatus 300 and 400 discussed above, the turbine 92 is eliminated and replaced with a direct drive including a drive shaft 502 that is operatively connected at one end to the blower motor 24 and at the opposite end is operatively connected to the blades 90, such that operation of the blower motor rotatingly drives the drive shaft and the blades 90. Further, spray nozzles 504 replace spray head 76.

Figure 14:
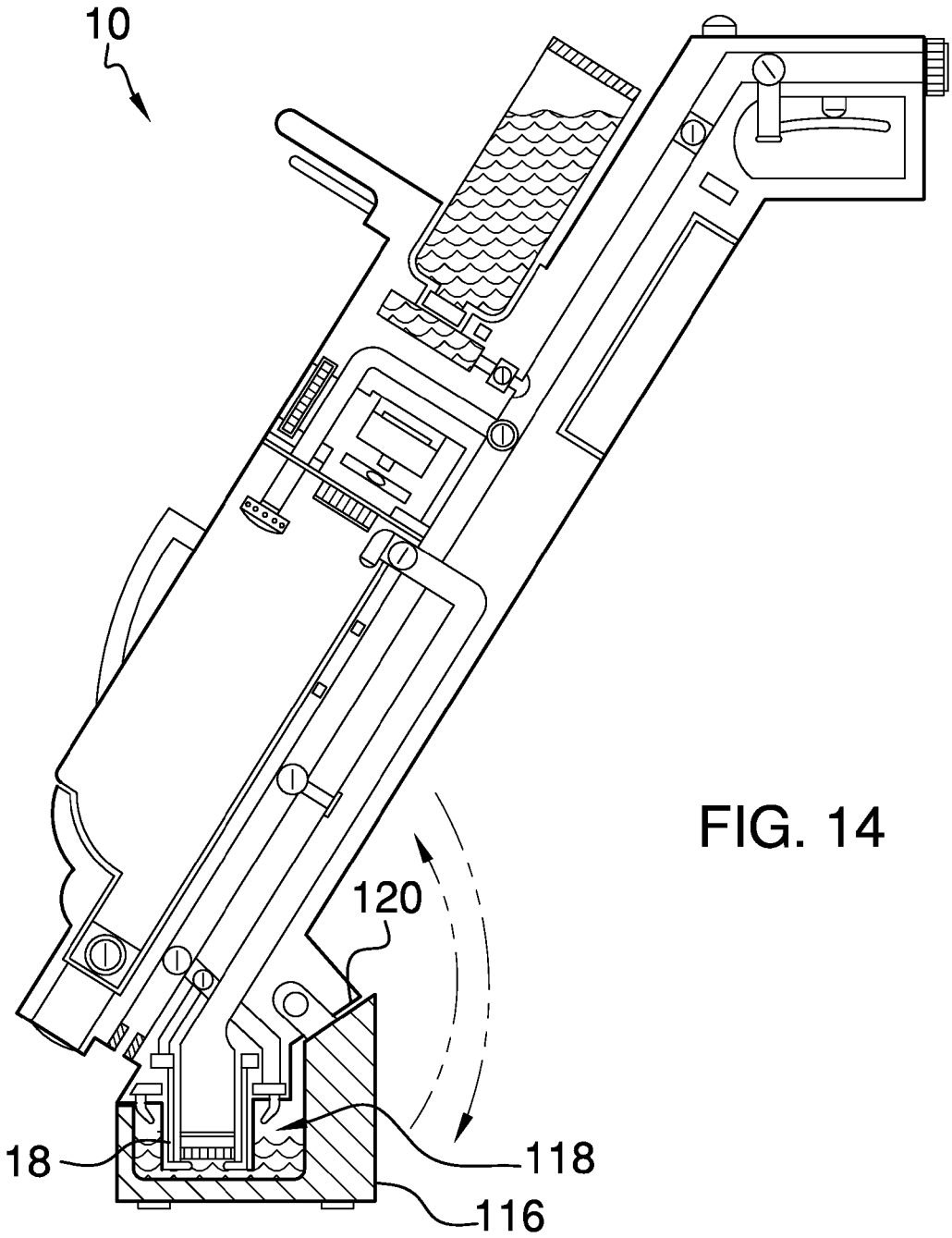
FIG. 14 is a diagrammatic view of the apparatus of FIG. 1 further including a washbasin and illustrating the washbasin in an in-use position.
Figure 15:
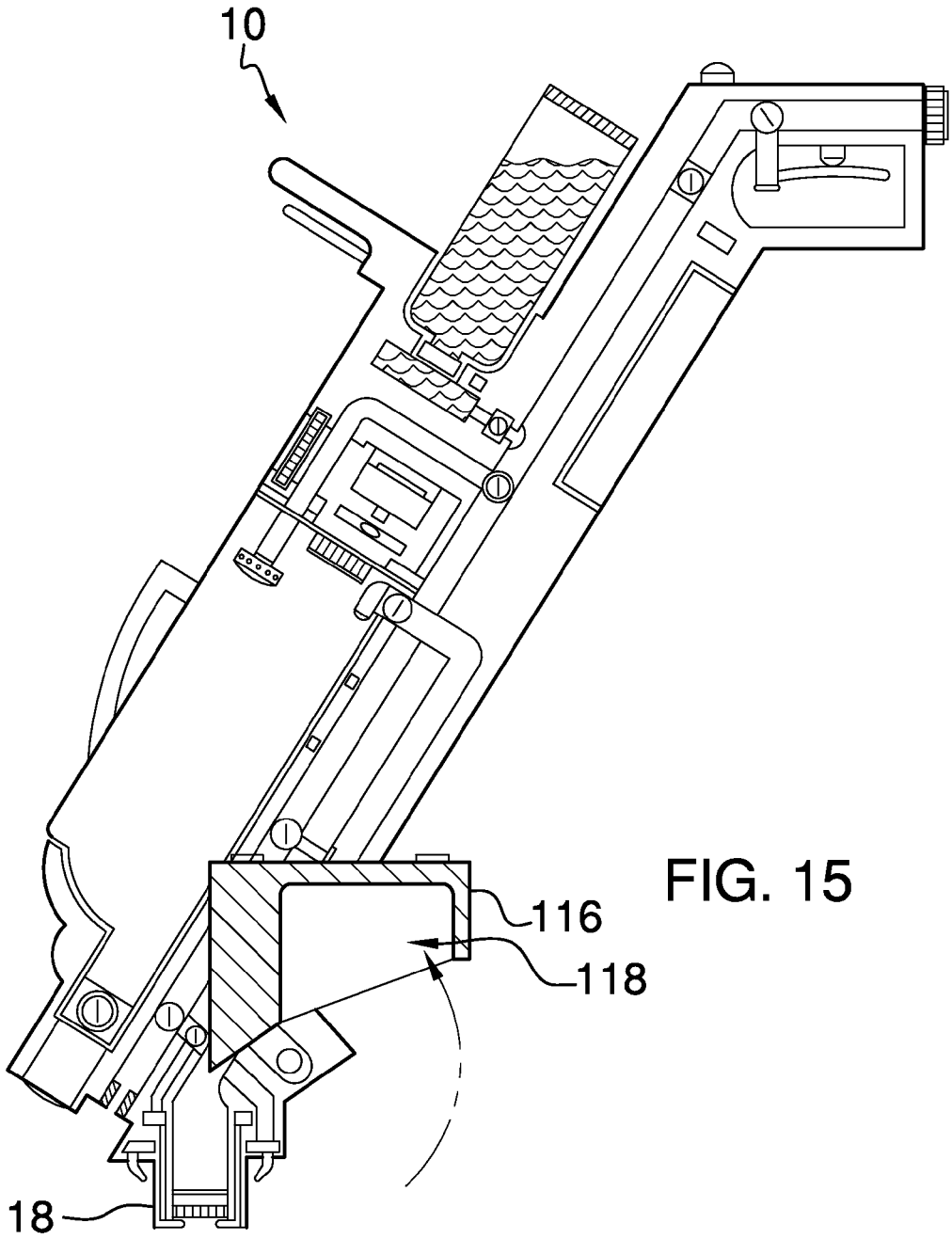
FIG. 15 is a diagrammatic view of the apparatus of FIG. 15 illustrating the washbasin in a non-use position.

In FIGS. 14 and 15, there is diagrammatically illustrated the apparatus 10 further including a washbasin 116 having a receptacle 118 into which is positionable the suction head 18 to aid in cleaning the suction head after use. The washbasin 116 is pivotally attached to the boom 12 for rotation between an in-use position wherein the suction head 18 is disposed within the receptacle 118, as depicted in FIG. 14, and a non-use position wherein the basin is rotated away from the suction head to permit unobstructed operation thereof, as depicted in FIG. 15. The washbasin is intended to be use during the self-cleaning of the suction head 18 as described above in reference to FIG. 6. A seal 120 is disposed between the contact surfaces of the boom 12 and the washbasin 116 to provide sealing contact therebetween. While not shown, apparatus 10 could include a manual level operatively connected to the washbasin 116 and operable to position the washbasin in the in-use and non-use positions. Additionally, the apparatus 10 could include a fluid sensor disposed at the washbasin and operatively connected to the various valves of the apparatus to facilitate a more complex control over the apparatus during self-cleaning. For example, the fluid sensor could be used to determine a fluid level within the washbasin to effect the opening and closing of valves and or to control the timing of the operation of the valves and/or blow motor according to a desired self-cleaning process.

Figure 16:
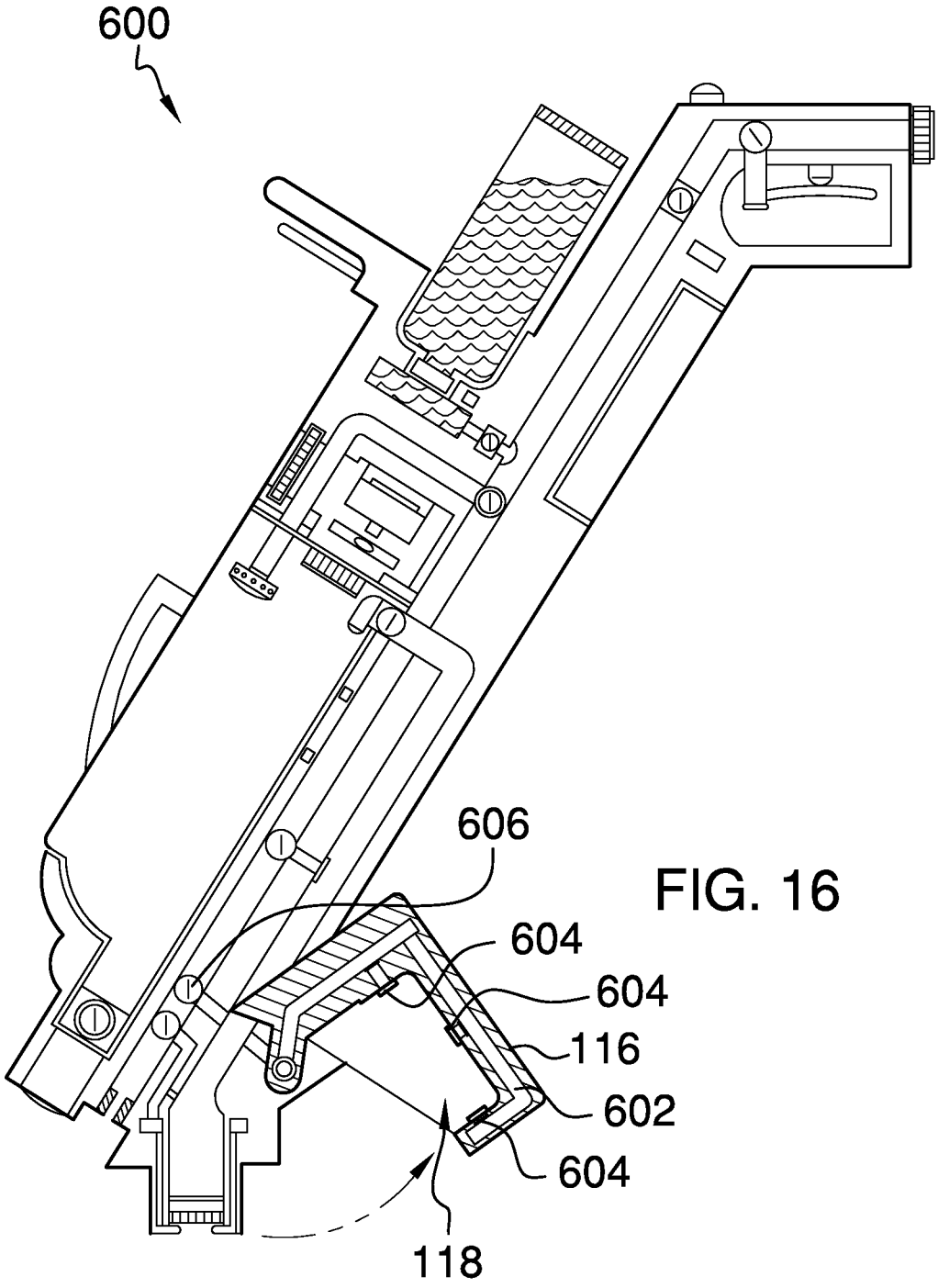
FIG. 16 is a diagrammatic view of the apparatus having an alternative construction of the washbasin of FIGS. 14 and 15 in the non-use position.
Figure 17:
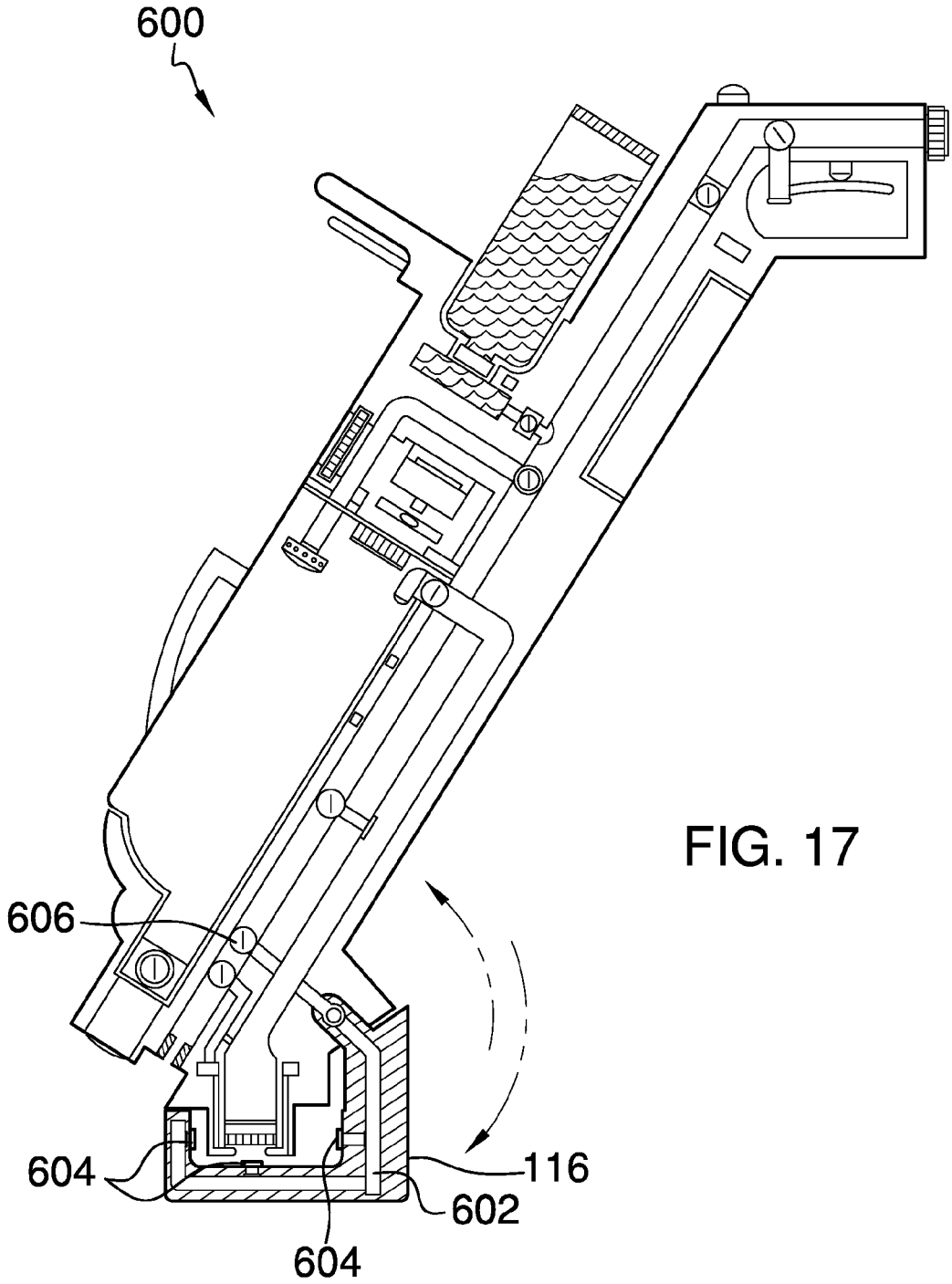
FIG. 17 is a diagrammatic view of the apparatus having the alternative washbasin construction of FIG. 16 and illustrating the washbasin in an in-use position.

In FIGS. 16 and 17 there is diagrammatically illustrated an alternative embodiment 600 of the invention, wherein the same reference numbers refer to similar parts. Apparatus 600 is an alternative construction to apparatus 10 of FIGS. 14 and 15 including the washbasin. Washbasin 116 further includes a fluid passage 602 to which is fluidically connected an array of spray heads 604 that are disposed along the interior of the receptacle 118 and generally positioned and configured to direct water against the suction head 18 during operation. Fluid passage 602 is connected to fluid passage 30 by washbasin valve 606. Apparatus 600 operates to operate washbasin valve 606 during the self-clean mode of operation to establish fluid flow from fluid passage 30 to spray heads 604.

Figure 18:
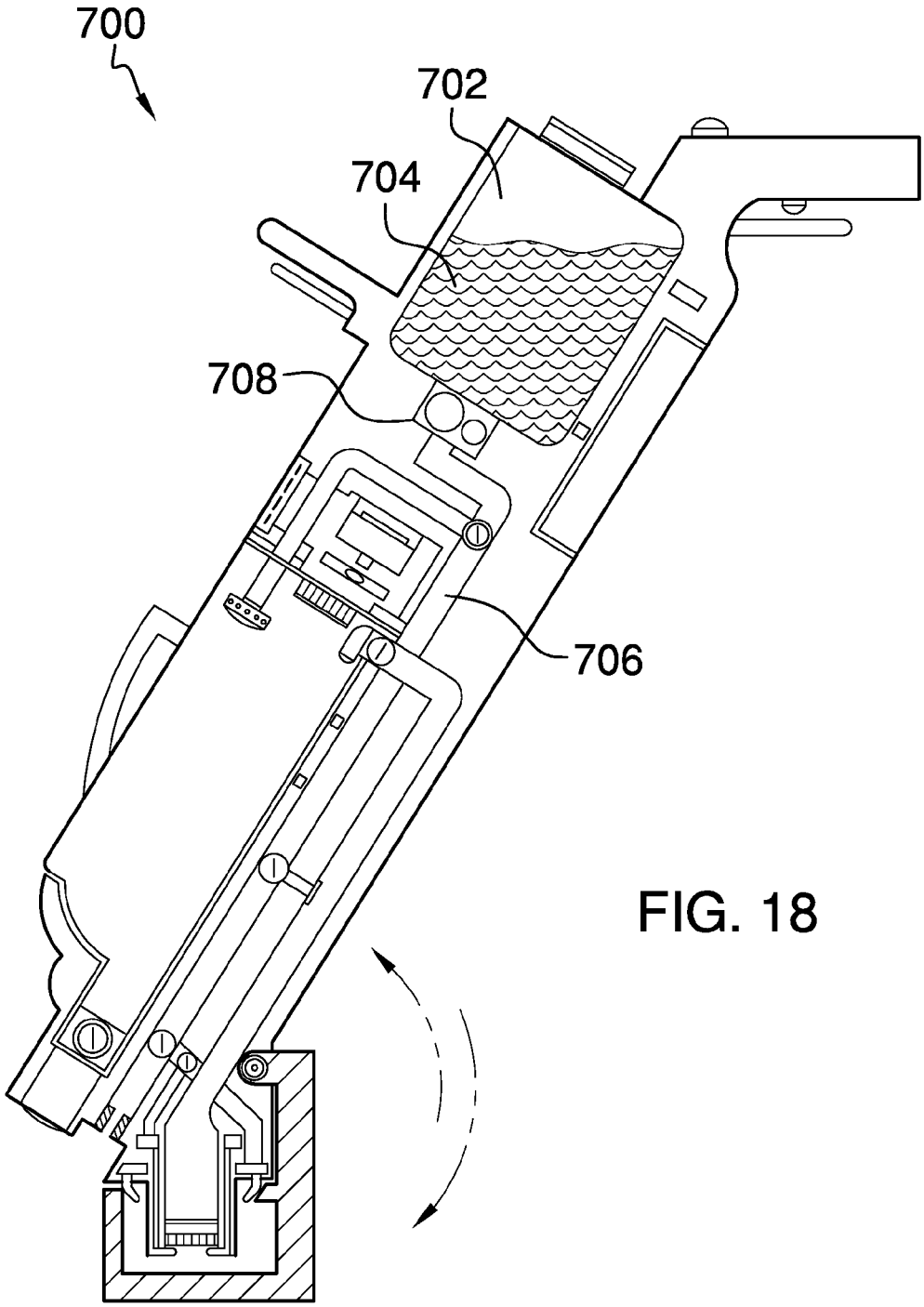
FIG. 18 is a diagrammatic view of an alternative embodiment of the apparatus.
Figure 19:
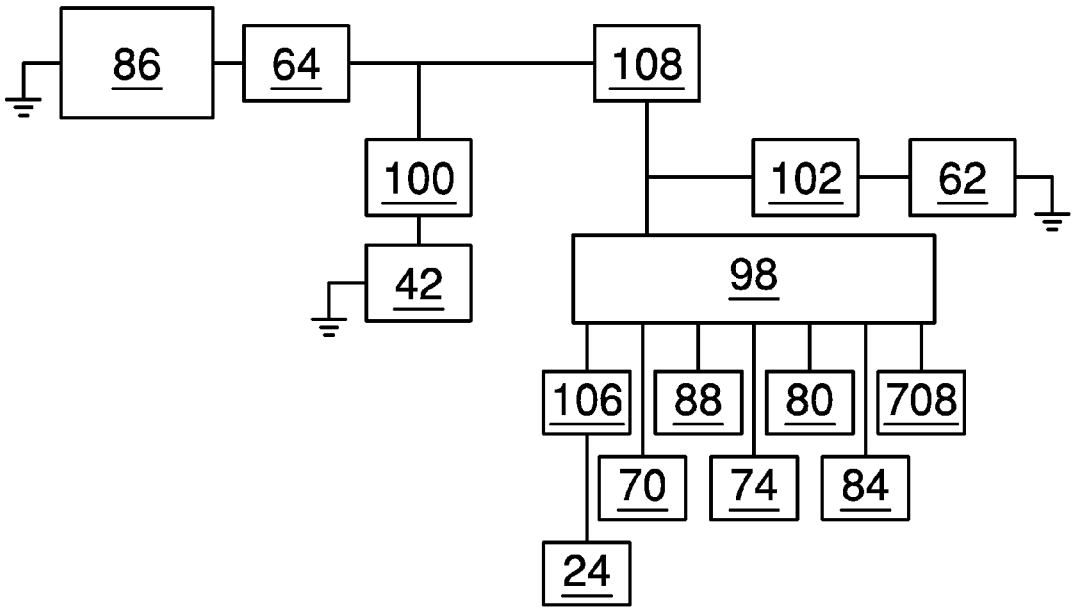
FIG. 19 is an exemplarily block diagram of an electrical schematic of the apparatus of FIG. 18.

FIG. 18 is a diagrammatic illustration of an alternative embodiment 700 of the invention, wherein the same reference numbers refer to similar parts. In apparatus 700 the external connection to a source of pressurized fluid, such as a garden hose, and the chemical dispenser are eliminated with an integrated fluid vessel 702 for holding a quantity of premixed chemical solution 704. Fluid passage 30 is replaced with fluid passage 706. Fluid passage 706 is essentially the same as fluid passage 30 except it is not connectable to an external hose to receive a source of pressurized fluid. Instead, fluid passage 706 is connected to the outlet of pump 708 and the inlet of pump 708 is connected to the fluid vessel 702. The pump 708 is operated to pump the chemical solution 704 into fluid passage 706 to be delivery to the various components of the apparatus 700 based upon the mode of operation thereof. A block diagram of an exemplary electrical schematic of the apparatus 10 is illustrated in FIG. 19. Additionally, while not illustrated here, apparatus 700 may also include the wiper blades 90 as discussed above. As to a further discussion of the manner of usage and operation of apparatus 700, the same should be apparent from the above description. Accordingly, no further discussion relating to the manner of usage and operation will be provided.

Figure 20:
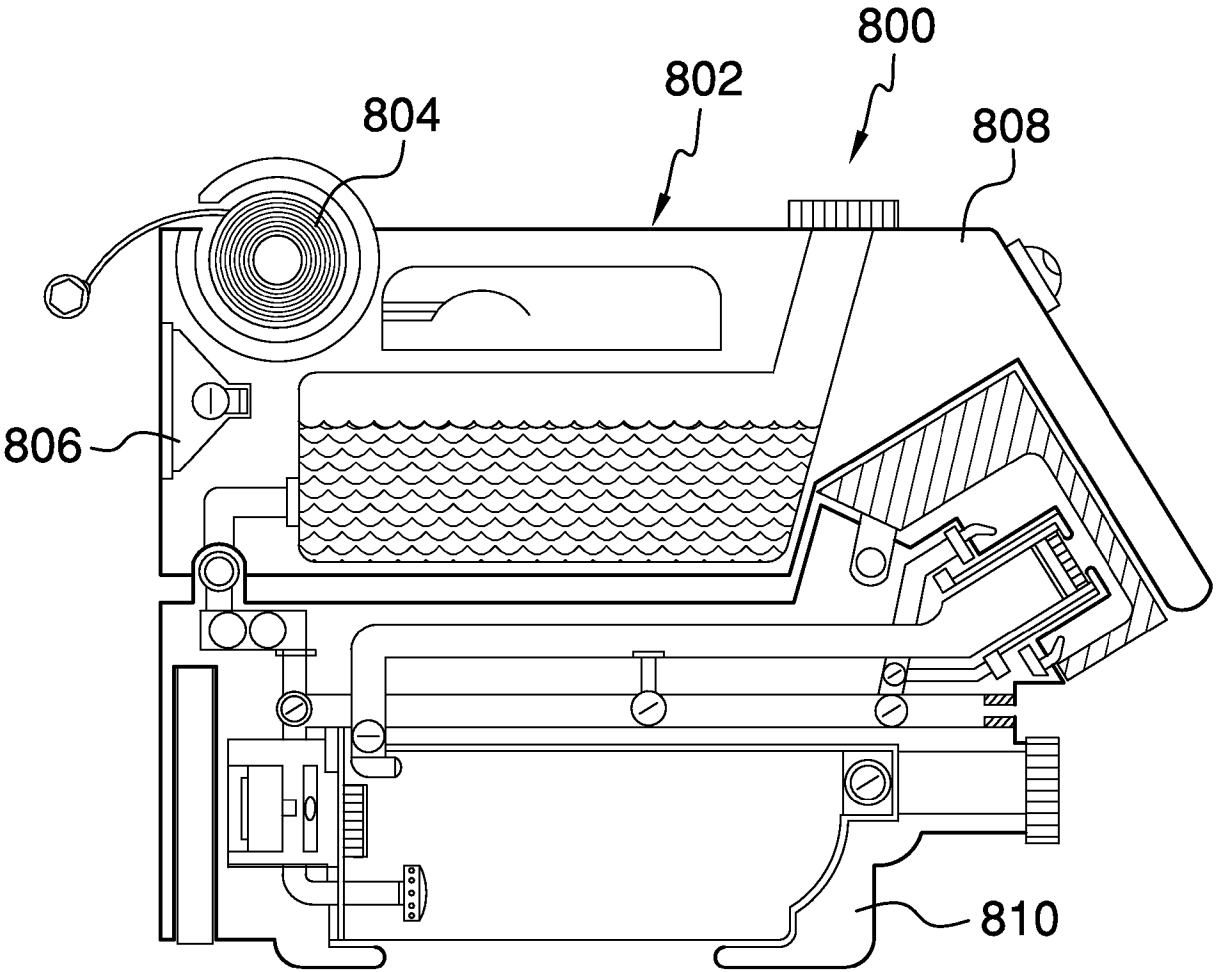
FIG. 20 is a diagrammatic view of an alternative embodiment of the apparatus and illustrating the apparatus in a collapsed configuration.
Figure 21:
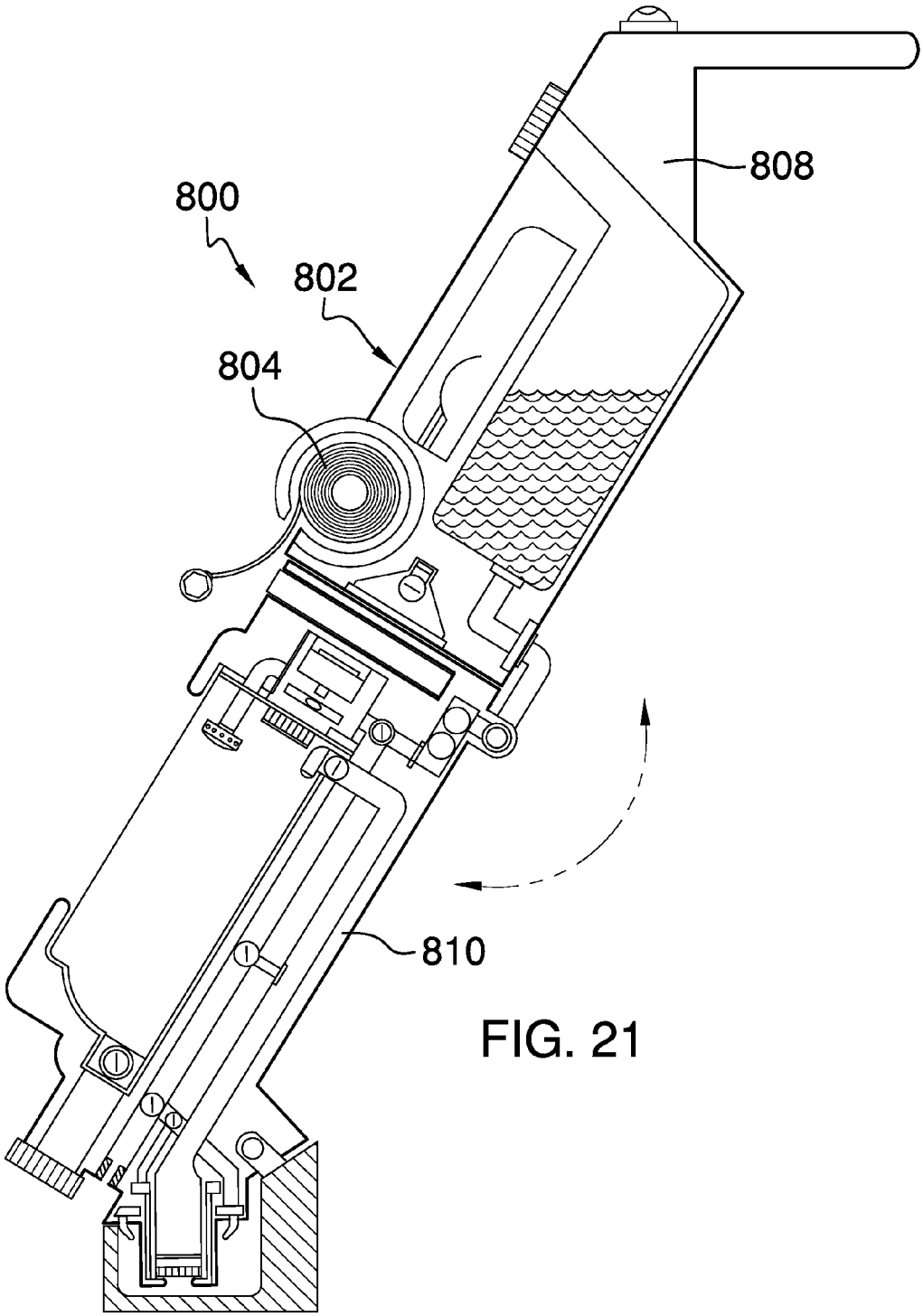
FIG. 21 is a diagrammatic view of the apparatus of FIG. 20 illustrating the apparatus in an extended configuration.

FIGS. 20 and 21 are diagrammatic illustrations of an alternative embodiment 800 of the invention, wherein the same reference numbers refer to similar parts. Apparatus 800 essentially comprises any of the above described embodiments with the exception of including a folding boom 802 and the inclusion of a tractable animal leash 804 and a flashlight 806. Boom 802 includes boom member 808 and boom member 810 that are pivotally attached to one another at corresponding ends such that the boom members are rotatable in a direction away and towards each other between a collapsed position, as seen in FIG. 20, and an extended position, as seen in FIG. 21.

Figure 22:
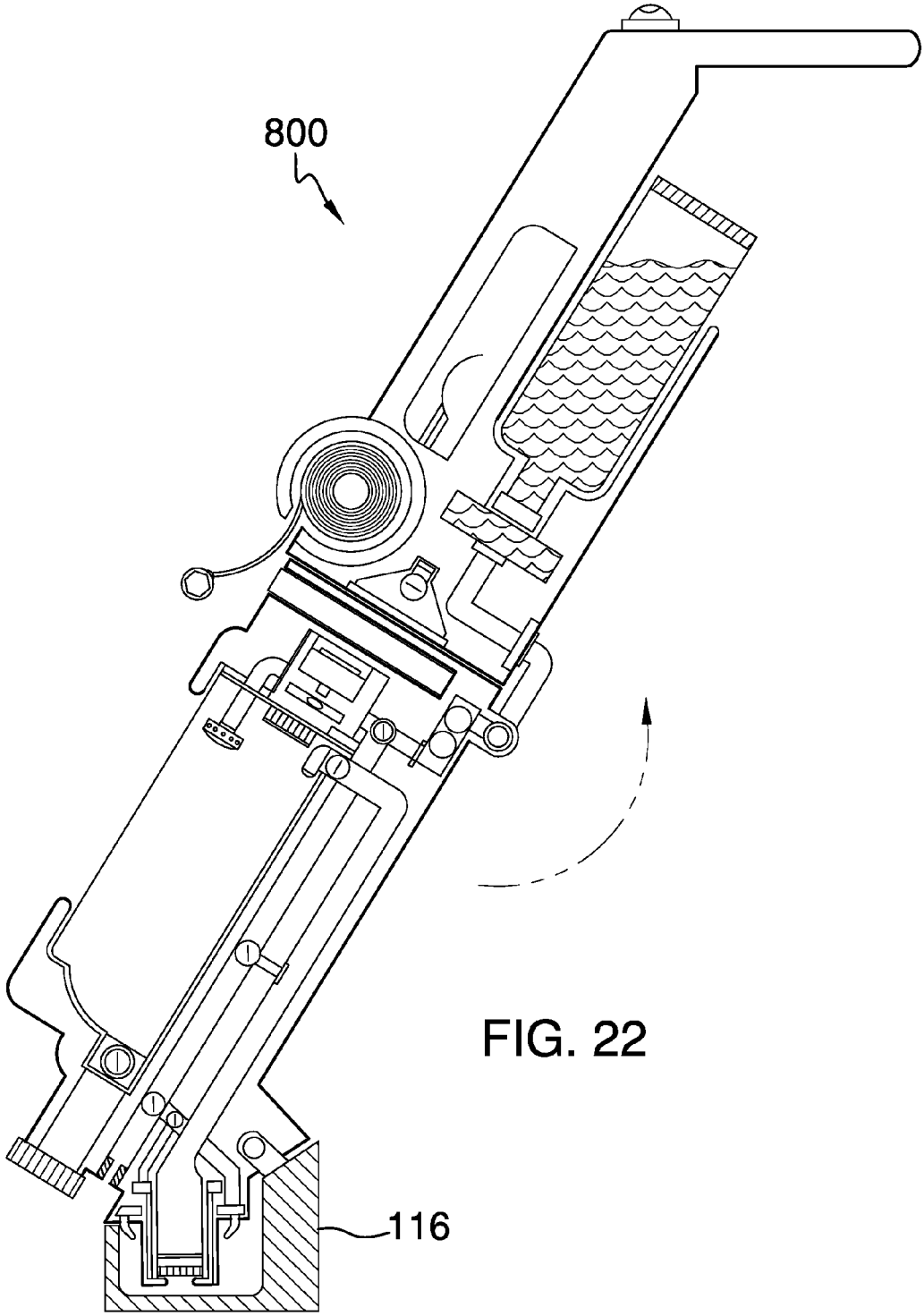
FIG. 22 is a diagrammatic view of yet another alternative embodiment of the apparatus.

FIG. 22 is a diagrammatic illustration of apparatus 800 further including a washbasin 116 and a removable fluid reservoir according to any one of the embodiments described above.

Figure 23:
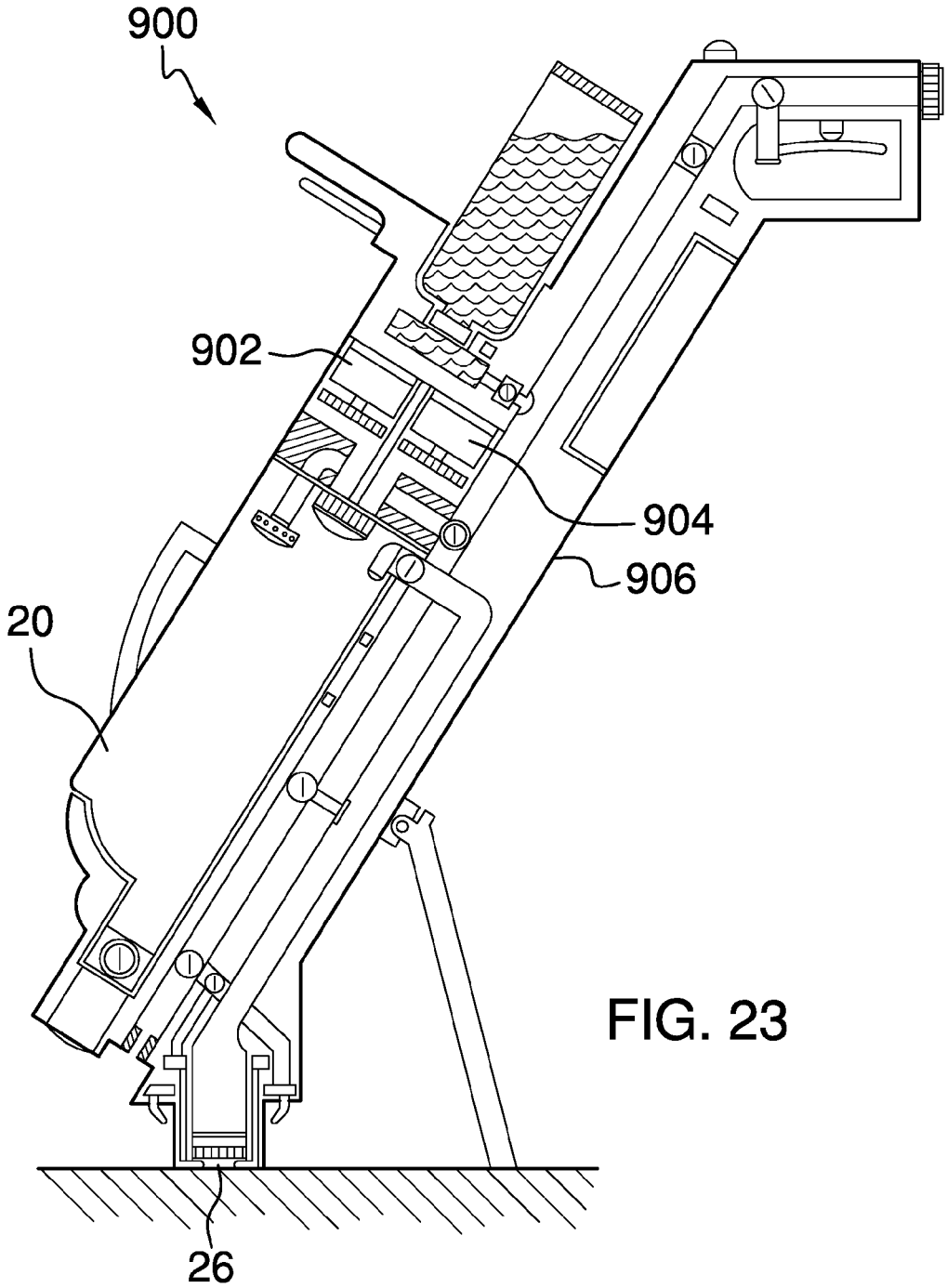
FIG. 23 is a diagrammatic view of yet another alternative embodiment of the apparatus.
Figure 24:
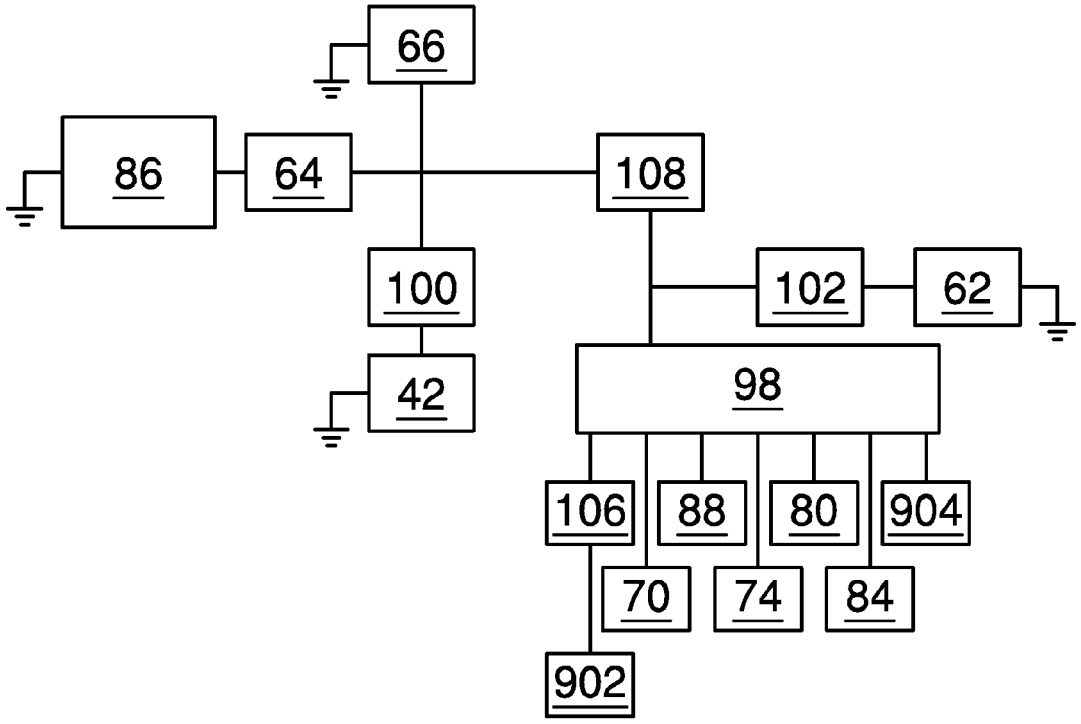
FIG. 24 is an exemplarily block diagram of an electrical schematic of the apparatus of FIG. 23.

FIG. 23 is a diagrammatic illustration of an alternative embodiment 900 of the invention, wherein the same reference numbers refer to similar parts. In the prior described embodiments a single vacuum motor 24 is provided and operable in both a vacuum mode and a blower mode. Apparatus 900 replaces vacuum motor 24 with a separately operated vacuum motor 902 and blower motor 904. Vacuum motor 902 and blower motor 904 are housed by boom 906. Boom 906 is configured such that operation of the vacuum motor 902 creates a vacuum in the receptacle 20 drawing air and material through the opening 26 of the vacuum suction head 18 and into the receptacle. Boom 906 is configured such that operation of the blower motor 904 creates either a positive flow of air through the receptacle 20 for flushing waste out from the receptacle or a positive flow of air through the suction head 18. A block diagram of an exemplary electrical schematic of the apparatus 900 is illustrated in FIG. 24. As to a further discussion of the manner of usage and operation of apparatus 900, the same should be apparent from the above description. Accordingly, no further discussion relating to the manner of usage and operation will be provided.

Figure 25:
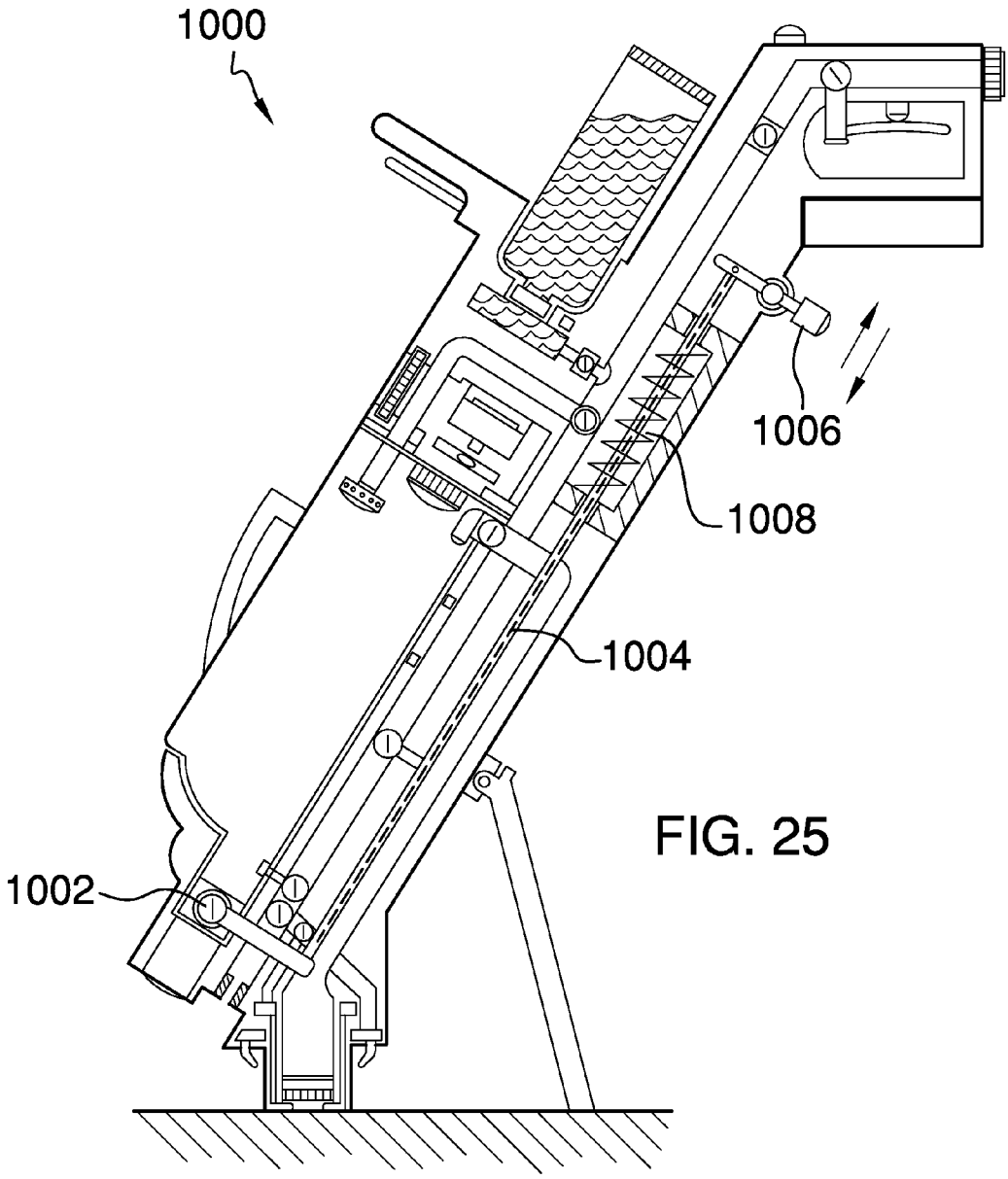
FIG. 25 is a diagrammatic view of still yet another alternative embodiment of the apparatus.

FIG. 25 is a diagrammatic illustration of an alternative embodiment 1000 of the invention, wherein the same reference numbers refer to similar parts. In the prior described embodiments evacuation of the vacuum receptacle 20 is controlled by an electrically operated discharge valve 74. Here, in apparatus 1000, the electrically operated discharge valve 74 is replaced by a manually operated valve 1002. A control rod 1004 is connected at one end to the valve 1002 and is connected to a control lever 1006 at the opposite end. Operating control lever 1006 opens and closes valve 1002. A biasing spring 1008 may be included to bias the control rod 1004 and control lever 1006 assembly such that valve 1002 is normally closed.

Figure 26:
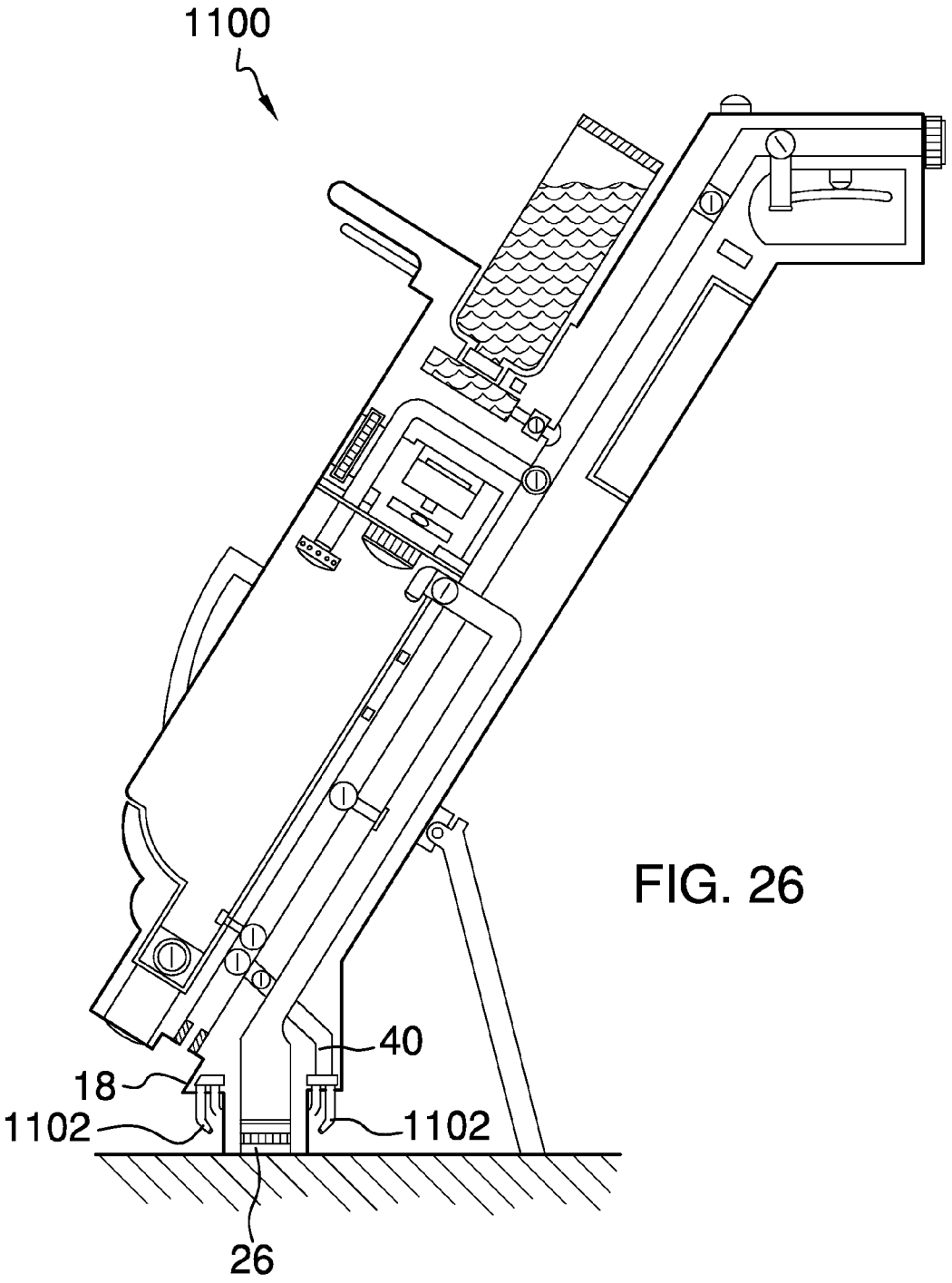
FIG. 26 is a diagrammatic view of still yet another alternative embodiment of the apparatus.
Figure 27:
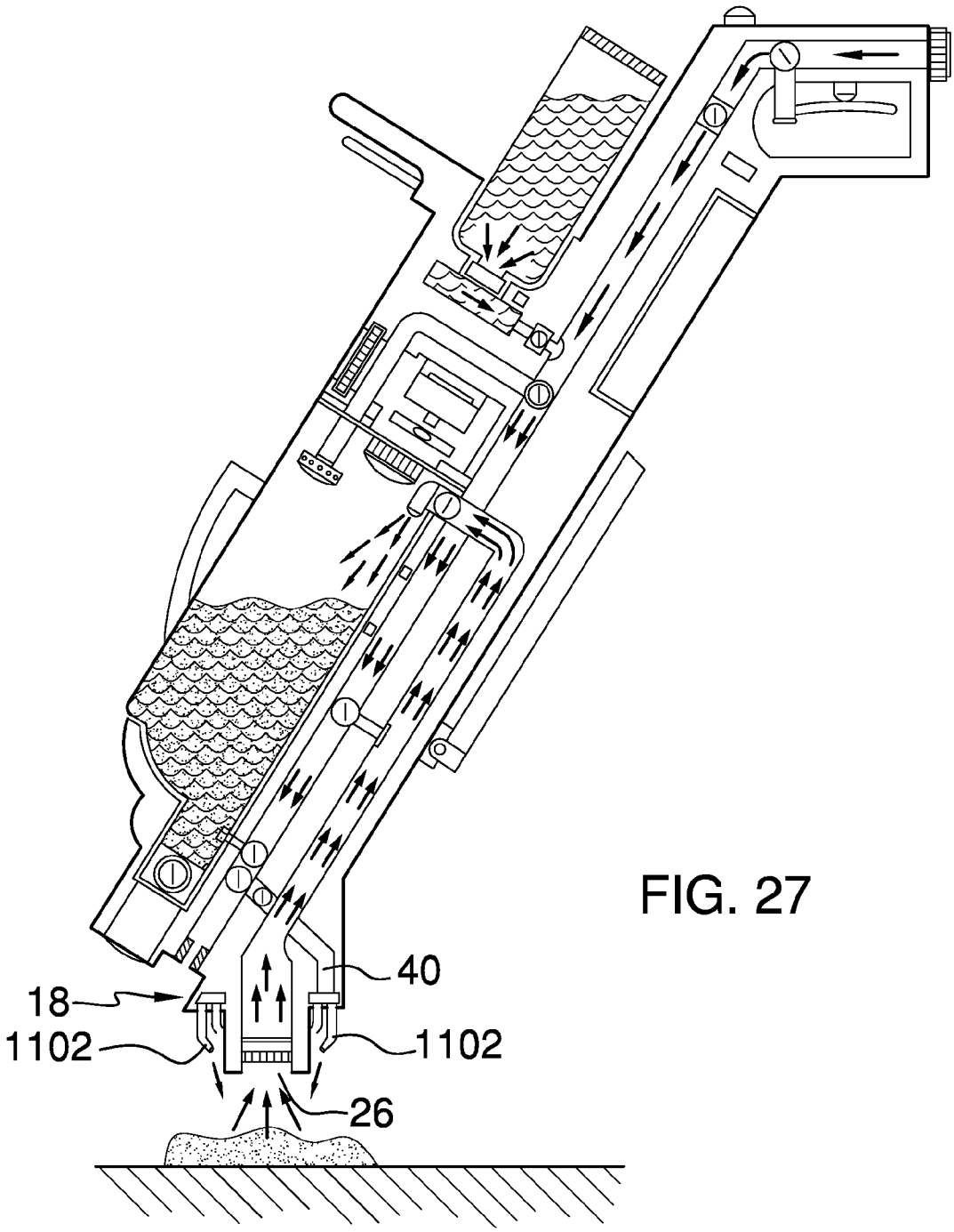
FIG. 27 is a diagrammatic view of still yet another alternative embodiment of the apparatus.

FIG. 26 is a diagrammatic illustration of an alternative embodiment 1100 of the invention, wherein the same reference numbers refer to similar parts. In apparatus 1100, spray nozzles 38 are replaced by spray nozzles 1102 which are connected to fluid passage 40. Spray nozzles 1102 are configured to direct a stream of fluid at waste material disposed in proximity to opening 26 of the suction head 18, as seen in FIG. 27. FIGS. 26 and 27 further depict an optional agitator and/or rotatable blade 1104 that may be located above or below the protective grill 34. An electric motor 1106 is operatively connected to the agitator 1104 and facilitates the breaking up and collection of waste material into the device when operated in vacuum mode as illustrated in FIG. 27. The agitator 1104 remains in, or in the alternative is put into, action when operated in self-cleaning mode after the device has been used, to ensure thorough cleaning before being safely stored away.

Figure 28:
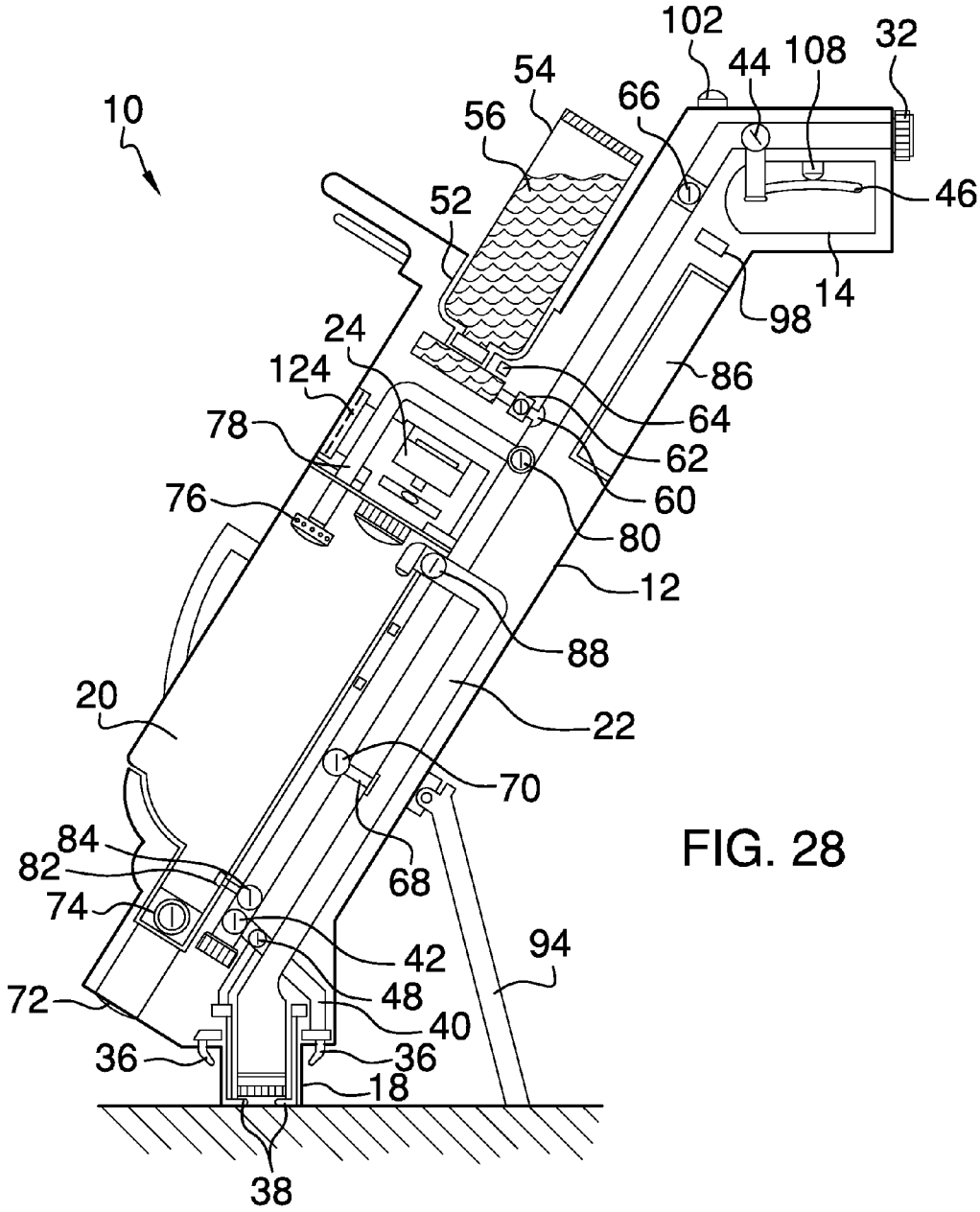
FIG. 28 is a diagrammatic view of still yet another alternative embodiment of the apparatus.

FIG. 28 is a diagrammatic illustration of apparatus 10 not including the exterior spray nozzle 28.

Figure 29:
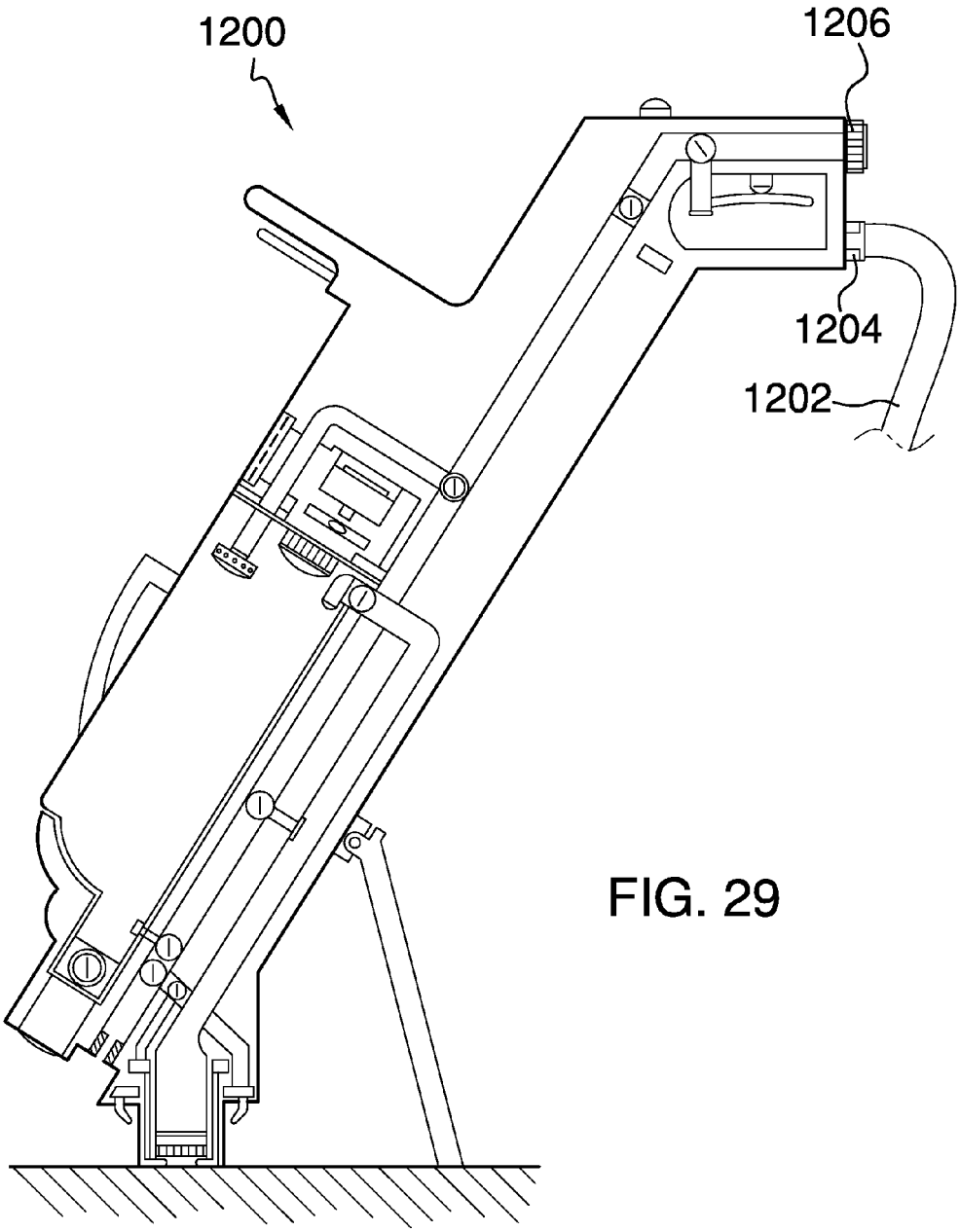
FIG. 29 is a diagrammatic view of still yet another alternative embodiment of the apparatus.

FIG. 29 is a diagrammatic illustration of an alternative embodiment 1200 of the invention, wherein the same reference numbers refer to similar parts. In apparatus 1200 the chemical dispenser 50 and associated components are eliminated. Further, the onboard power supply 86 is replaced in favor of line-power that is connected to device 1200 via electrical power cord 1202 to provide electrical power to the various electrical components of the device. Power cord 1202 may be removably connected to the device 1200 by a cooperating socket 1204. In another aspect, coupling 32 could be replaced by a safety hose coupling 1206 that is configured to couple to only a specified hose that may be connected to a supply of pressurized treatment solution. A skilled artisan will readily appreciate and understand the operation of this embodiment taken in consideration with the above described operation of the first embodiment.

Figure 30:
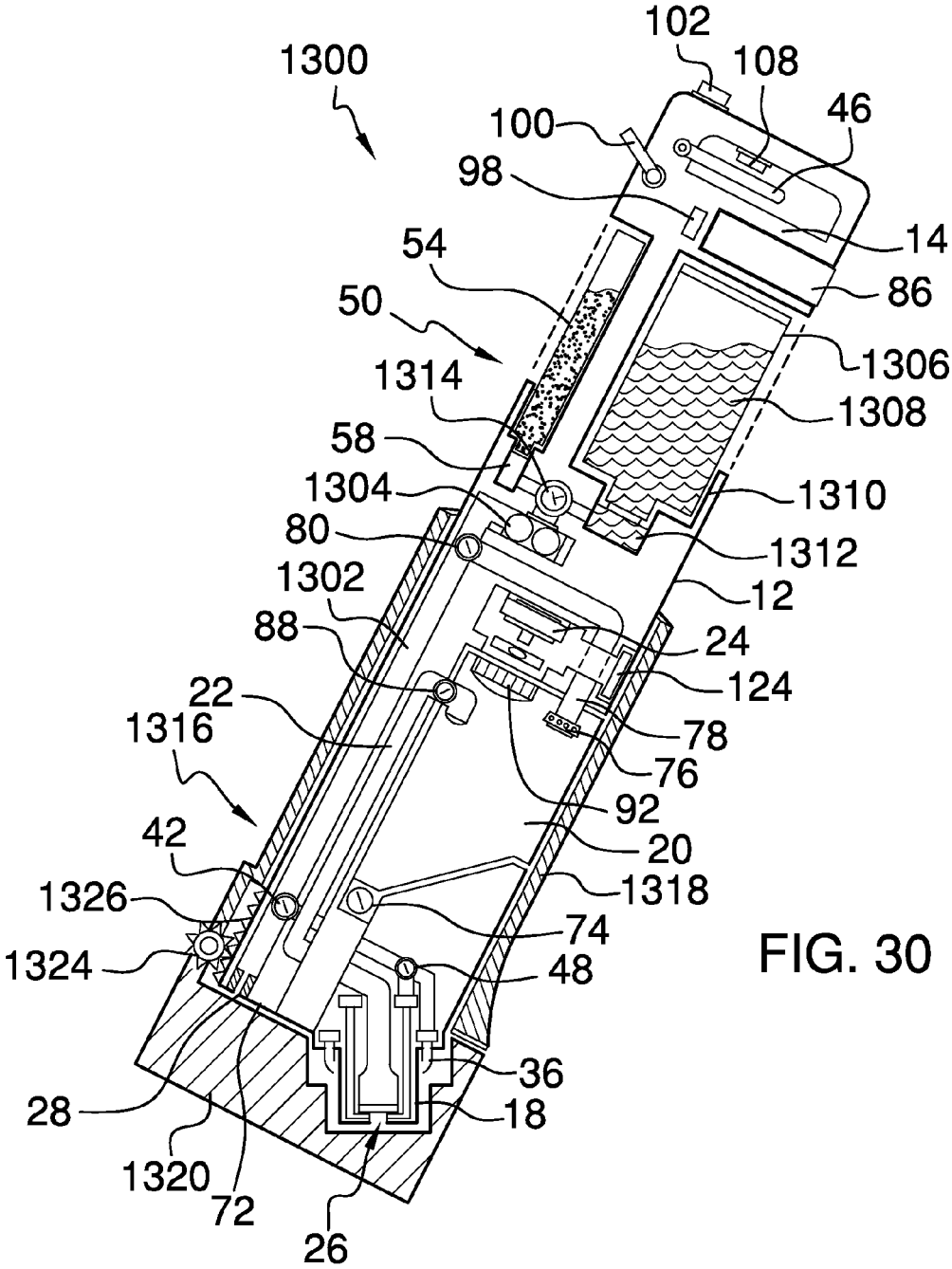
FIG. 30 is a diagrammatic view of yet a further alternative embodiment of the apparatus shown in a first configuration.
Figure 31:
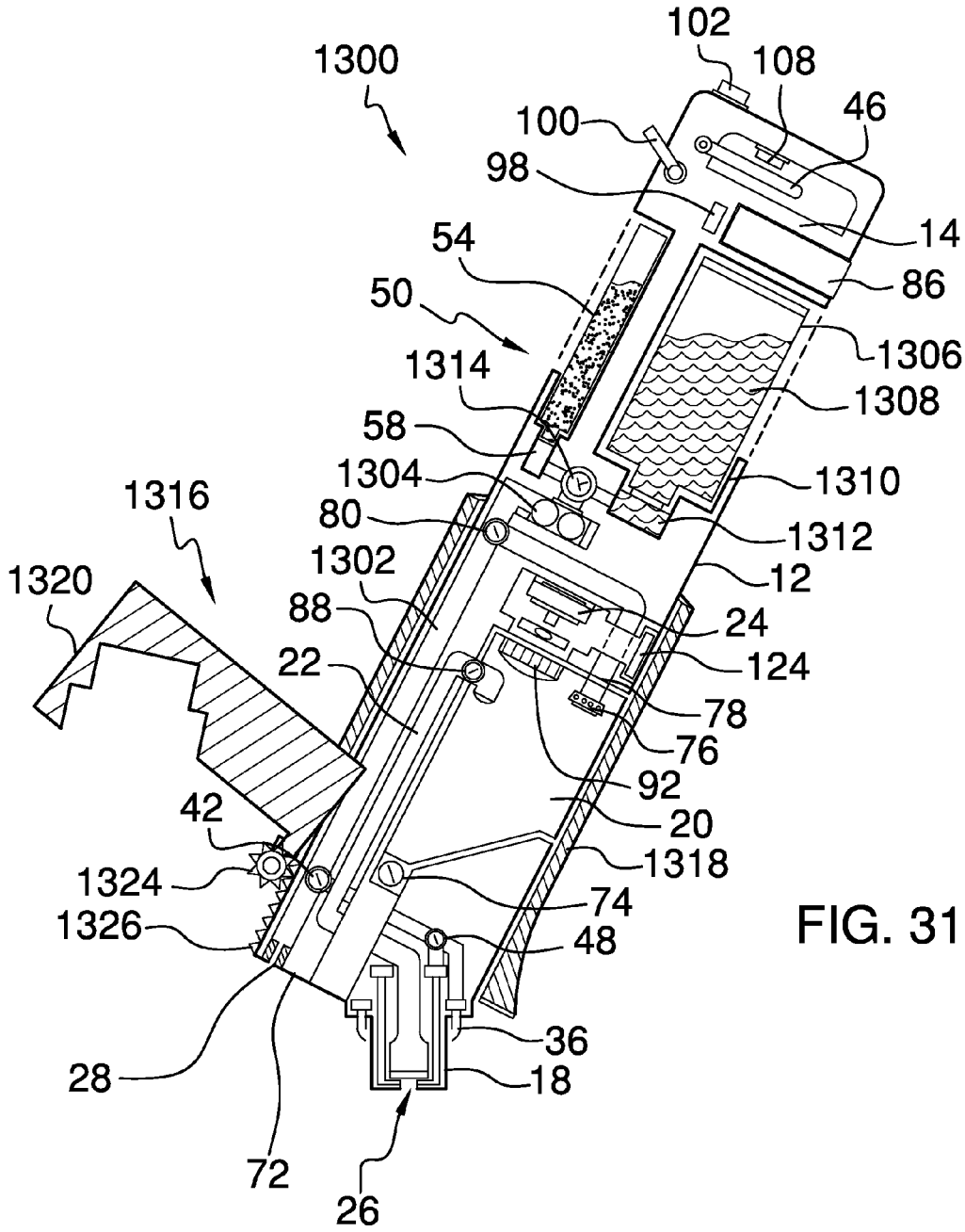
FIG. 31 is a diagrammatic view of the embodiment of FIG. 30 shown in a second configuration.

FIGS. 30 and 31 are diagrammatic illustrations of yet another alternative embodiment 1300 of the invention, wherein the same reference numbers refer to similar parts. In apparatus 1300, fluid passage 1302 replaces fluid passage 30, and includes nozzle 28 at one end, while the opposite end is connected to an electric pump 1304. Apparatus 1300 further includes a reservoir 1306 for receiving and holding a quantity of fresh water 1308. Reservoir 1306 may be integral with boom 12, or alternatively, the reservoir is removably receivable and retained by a holder 1310 of the boom. Reservoir 1306 is fluidically connected to a fresh water accumulator 1312, which receives therein water from the reservoir under gravity.

A selector valve 1314 connects the fresh water accumulator 312 and the chemical dispenser accumulator 58 to the electric pump 1304. The selector valve 1314 operates to selectively and independently fluidically connect the fresh water accumulator 1312 or the chemical dispenser accumulator 58 to the electric pump 1304 for pumping fresh water or chemical concentrate, respectively, through passage 1302. Additionally, selector valve 1314 operates to fluidically connect the fresh water accumulator 1312 and the chemical dispenser accumulator 58 to the electric pump 1304 for pumping an admixture of fresh water and chemical concentrate through passage 1302.

Apparatus 1300 further includes a cover system 1316 comprising a slidable sheath 1318 and a hinged cover 1320. Sheath 1318 encircles boom 12 at the bottom end thereof, and is slidable between a lowered position, as depicted in FIG. 30, and a raised position, as depicted in FIG. 31. Cover 1320 is hingedly connected to sheath 1318 and is rotatable between positions where the suction head 18 is covered by the cover and where the suction head is not covered by the cover, as depicted in FIGS. 30 and 31, respectively.

Cover system 1316 may further include a track 1322 and an engaged pinion 1324. The track is located on the exterior of the boom 12 and extends vertically thereupon. The pinion 1324 is located at the hinged connection between the cover 1320 and the sheath 1318. The pinion 1324 is operatively connected to the cover 1320 and sheath 1318 such that sliding sheath 1318 causes the pinion 1324 to operate against track 1322 and rotate the cover between the covered and uncovered positions. That is, raising sheath 1318 causes the cover 1320 to rotate in a direction away from the suction head 18, and lowering sheath 1318 causes the cover 1320 to rotate in a direction towards the suction head. One of ordinary skill in the art will readily appreciate the further operation of apparatus 1300 when taken in connection with the above description.

Figure 32:
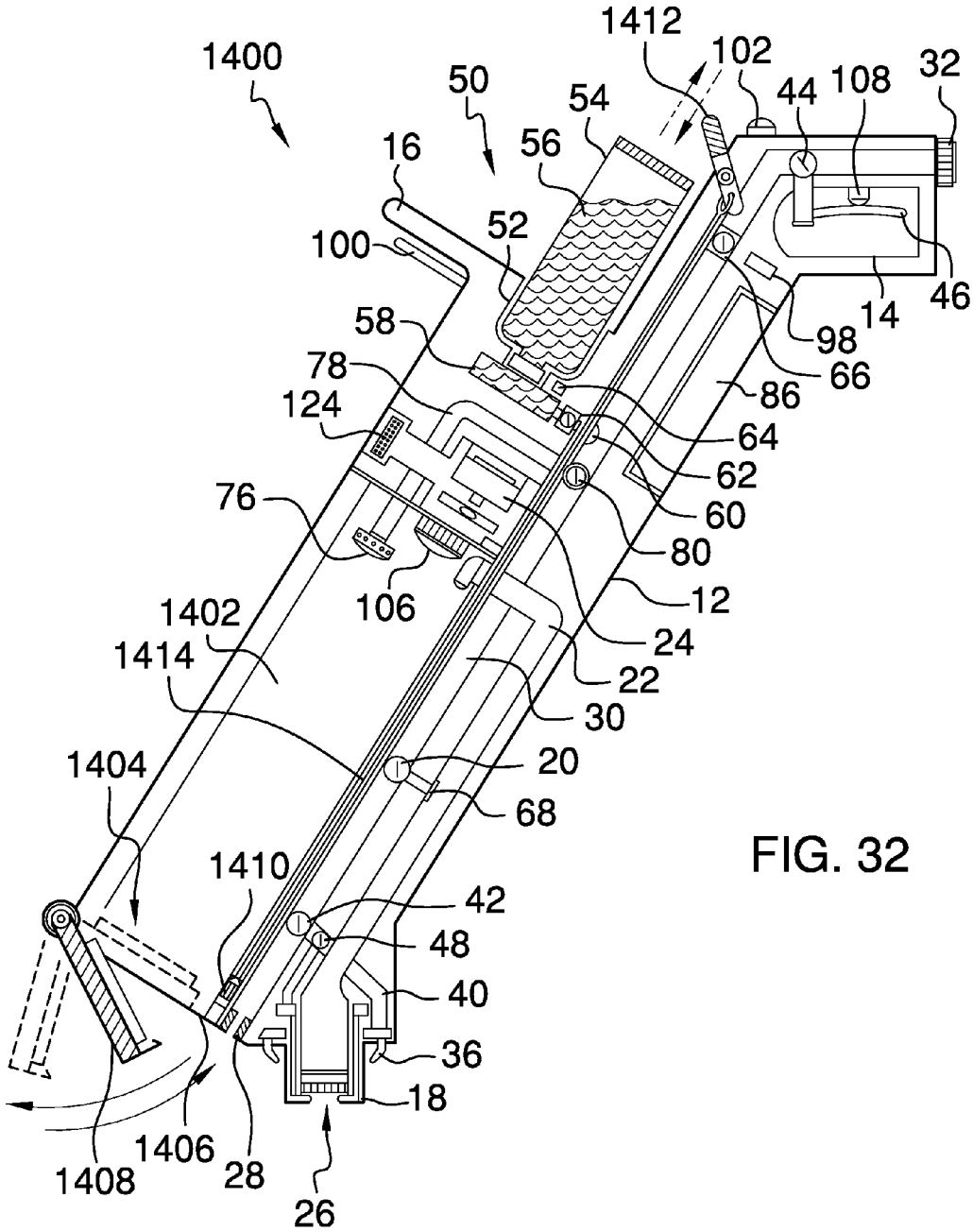
FIG. 32 is a diagrammatic view of yet a further alternative embodiment of the apparatus.

FIG. 32 is a diagrammatic illustration of yet another alternative embodiment 1400 of the invention, wherein the same reference numbers refer to similar parts. In apparatus 1400, waste receptacle 20 is replaced with waste receptacle 1402, which includes a discharge opening 1404 at the exterior end 1406 thereof. A lid 1408 is pivotally attached to end 1406, and is rotatable between a first position where the lid is engaged with end 1406 and sealing the discharge opening 1404 and a second position where the lid is not engaged with end 1406 and the discharge opening is open to permit emptying of the waste receptacle 1402.

Apparatus 1400 may further include a latch 1410 that is operable to retain the lid 1408 in the closed position wherein the discharge opening 1404 is sealed. Latch 1410 may be operable by a lever 1412 that is operatively connected to the latch, for example by a rod, cable or other linkage 1414. Operation of lever 1412 causes latch 1410 to operate, and thus release the lid 1408 from the closed position. One of ordinary skill in the art will readily appreciate the further operation of apparatus 1400 when taken in connection with the above description.

Figure 33:
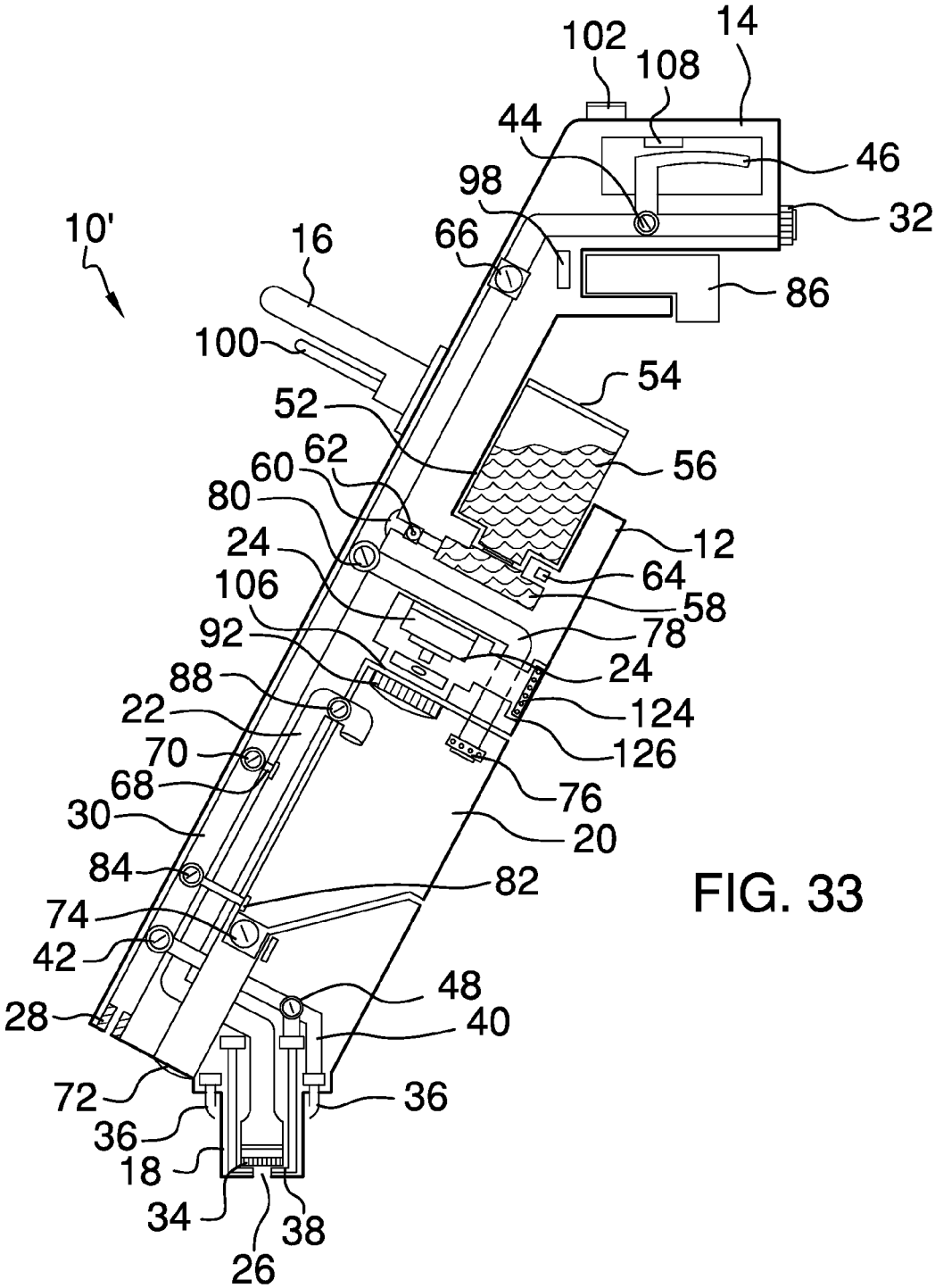
FIG. 33 is a diagrammatic view of yet a further alternative embodiment of the apparatus.

FIG. 33 is a diagrammatic illustration of yet another alternative embodiment 10' of the invention, wherein the same reference numbers refer to similar parts. Embodiment 10' is an illustrative example of how the components of the invention may be alternatively arranged while remaining within the scope of the invention.

A number of embodiments of the present invention have been described. Nevertheless, it will be understood that various modifications may be made without departing from the spirit and scope of the invention. Accordingly, other embodiments are within the scope of the following claims.

What is claimed is:

1. An apparatus for clearing waste from a surface, comprising:

a vacuum suction head having a suction opening for accepting waste material;

a waste receptacle for storing waste material that are vacuumed through said suction opening, said waste receptacle having a discharge port through which waste material stored within said waste receptacle may be discharged for emptying said waste receptacle;

a vacuum passage fluidically connecting said suction opening and said waste receptacle;

a reversible vacuum pump in communication with said waste receptacle for alternately providing a vacuum on said waste receptacle and pressurizing said waste receptacle;

a vacuum passage valve disposed across said vacuum passage, said vacuum passage valve operable to alternately permit or preclude a flow through said vacuum passage;

a waste receptacle discharge valve disposed across said discharge port, said waste receptacle discharge valve operable to alternately permit or preclude a flow through said discharge port;

a fluid passage configured at one end to be connected to a source of pressurized water by a garden hose;

a first spray nozzle connected to an end of said fluid passage and configured to jet fluid from said fluid passage in a direction away from an operator and against material on the surface; and a control valve disposed across said fluid passage, said control valve operable to alternately permit or preclude a flow through said fluid passage.

2. The apparatus of claim 1, further comprising:

a chemical dispenser for storing a chemical solution, said chemical dispenser fluidically connected to said fluid passage and operating to admix the chemical solution with water flowing through said fluid passage.

3. The apparatus of claim 2, further comprising:

a vacuum passage spray nozzle fluidically connected to said fluid passage and configured and disposed to spray fluid from said fluid passage into said vacuum passage at location intermediate said suction head and said waste collection receptacle; and a vacuum passage spray nozzle valve operable to alternately permit or preclude a flow through said vacuum passage spray nozzle.

4. The apparatus of claim 3, further comprising:

a discharge port spray nozzle fluidically connected to said fluid passage and configured and disposed to spray a fluid from said fluid passage into said discharge port; and a discharge port spray nozzle valve operable to alternately permit or preclude a flow through said discharge port spray nozzle.

5. The apparatus of claim 3, further comprising:

a spray head fluidically connected to said fluid passage and configured and disposed to spray a fluid from said fluid passage within said waste receptacle for flushing the interior thereof; and a spray head valve operable to alternately permit or preclude a flow through said spray head.

6. The apparatus of claim 3, further comprising:

one or more second spray nozzles fluidically connected to said fluid passage and configured and disposed to spray a fluid from said fluid passage on to an exterior surface of said suction head for cleaning debris therefrom;

one or more third spray nozzles fluidically connected to said fluid passage and configured and disposed to spray a fluid from said fluid passage at said suction opening; and a spray nozzle selector valve operable to selectively and alternately permit or preclude a flow through said first spray nozzle and concurrently through said one or more second spray nozzles and said one or more third spray nozzles.

7. The apparatus of claim 6, further comprising:

a second spray nozzle selector valve operable to selectively and alternately permit or preclude a flow through said one or more second spray nozzles and said one or more third spray nozzles.

8. The apparatus of claim 1, wherein said waste receptacle is removable from said apparatus to permit emptying thereof.

9. The apparatus of claim 1, further comprising:

one or more wiper blades disposed within said waste receptacle and in contact with an interior surface thereof and operable to wipe said interior surface thereof.

10. The apparatus of claim 1, further comprising:

one or more waste material level sensors for sensing the volume of waste material in said waste receptacle.

11. The apparatus of claim 1, further comprising:

a washbasin having a receptacle into which said suction head is positional, said washbasin being pivotally mounted for rotation between positions wherein said suction head is positioned within said washbasin receptacle and where said suction head is not positioned within said washbasin receptacle.

12. The apparatus of claim 11, further comprising:

one or more washbasin spray heads disposed along the interior of said washbasin receptacle that are configured to direct fluid against said suction head when positioned within said washbasin receptacle, said one or more washbasin spray heads being fluidically connected to said fluid passage; and a washbasin valve operable to alternately permit or preclude a flow through said one or more washbasin spray heads.

13. The apparatus of claim 1, further comprising:

first and second boom half portions pivotally connected together such that they are rotatable relative to each other between a first collapsed position and a second extended position.

14. An apparatus for clearing waste from a surface, comprising:

a vacuum suction head having a suction opening for accepting waste material;

a waste receptacle for storing waste material that are vacuumed through said suction opening, said waste receptacle having a discharge port through which waste material stored within said waste receptacle may be discharged for emptying said waste receptacle;

a vacuum passage fluidically connecting said suction opening and said waste receptacle;

a reversible vacuum pump in communication with said waste receptacle for alternately providing a vacuum on said waste receptacle and pressurizing said waste receptacle;

a vacuum passage valve disposed across said vacuum passage, said vacuum passage valve operable to alternately permit or preclude a flow through said vacuum passage;

a waste receptacle discharge valve disposed across said discharge port, said waste receptacle discharge valve operable to alternately permit or preclude a flow through said discharge port;

a fluid reservoir for holding a quantity of chemical solution;

a pump fluidically connected to said fluid reservoir and operable to pump chemical solution therefrom;

a fluid passage connected at one end to said pump for receiving pumped chemical solution; and a first spray nozzle connected to an end of said fluid passage and configured to jet fluid from said fluid passage in a direction away from an operator and against material on the surface.

15. The apparatus of claim 14, further comprising:

a vacuum passage spray nozzle fluidically connected to said fluid passage and configured and disposed to spray fluid from said fluid passage into said vacuum passage at location intermediate said suction head and said waste collection receptacle; and a vacuum passage spray nozzle valve operable to alternately permit or preclude a flow through said vacuum passage spray nozzle.

16. The apparatus of claim 14, further comprising:

a discharge port spray nozzle fluidically connected to said fluid passage and configured and disposed to spray a fluid from said fluid passage into said discharge port; and a discharge port spray nozzle valve operable to alternately permit or preclude a flow through said discharge port spray nozzle.

17. The apparatus of claim 14, further comprising:

a spray head fluidically connected to said fluid passage and configured and disposed to spray a fluid from said fluid passage within said waste receptacle for flushing the interior thereof; and a spray head valve operable to alternately permit or preclude a flow through said spray head.

18. The apparatus of claim 14, further comprising:

one or more second spray nozzles fluidically connected to said fluid passage and configured and disposed to spray a fluid from said fluid passage on to an exterior surface of said suction head for cleaning debris therefrom;

one or more third spray nozzles fluidically connected to said fluid passage and configured and disposed to spray a fluid from said fluid passage at said suction opening; and a spray nozzle selector valve operable to selectively and alternately permit or preclude a flow through said first spray nozzle and concurrently through said one or more second spray nozzles and said one or more third spray nozzles.

19. The apparatus of claim 18, further comprising:

a second spray nozzle selector valve operable to selectively and alternately permit or preclude a flow through said one or more second spray nozzles and said one or more third spray nozzles.

20. The apparatus of claim 14, wherein said waste receptacle is removable from said apparatus to permit emptying thereof.

21. The apparatus of claim 14, further comprising:

first and second boom half portions pivotally connected together such that they are rotatable relative to each other between a first collapsed position and a second extended position.

22. An apparatus for clearing waste from a surface, comprising:

a vacuum suction head having a suction opening for accepting waste material;

a waste receptacle for storing waste material that are vacuumed through said suction opening, said waste receptacle having a discharge port through which waste material stored within said waste receptacle may be discharged for emptying said waste receptacle;

a vacuum passage fluidically connecting said suction opening and said waste receptacle;

a reversible vacuum pump in communication with said waste receptacle for alternately providing a vacuum on said waste receptacle and pressurizing said waste receptacle;

a vacuum passage valve disposed across said vacuum passage, said vacuum passage valve operable to alternately permit or preclude a flow through said vacuum passage;

a waste receptacle discharge valve disposed across said discharge port, said waste receptacle discharge valve operable to alternately permit or preclude a flow through said discharge port;

a fluid reservoir for holding a quantity of fresh water;

a chemical concentrate container for holding a quantity of chemical concentrate;

a pump fluidically connected to said fluid reservoir and operable to pump fresh water therefrom, said pump fluidically connected to said chemical concentrate container and operable to pump chemical concentrate therefrom;

a valve operable to selectively and fluidically connect said fluid reservoir to said pump, fluidically connect said chemical concentrate container to said pump, or fluidically connect said chemical concentrate container and said fluid reservoir concurrently to said pump;

a fluid passage connected at one end to said pump for receiving pumped fluid therefrom; and a first spray nozzle connected to an end of said fluid passage and configured to jet fluid from said fluid passage in a direction away from an operator and against material on the surface.

23. The apparatus of claim 22, further comprising:

a spray head fluidically connected to said fluid passage and configured and disposed to spray a fluid from said fluid passage within said waste receptacle for flushing the interior thereof; and a spray head valve operable to alternately permit or preclude a flow through said spray head.

24. The apparatus of claim 22, further comprising:

one or more second spray nozzles fluidically connected to said fluid passage and configured and disposed to spray a fluid from said fluid passage on to an exterior surface of said suction head for cleaning debris therefrom;

one or more third spray nozzles fluidically connected to said fluid passage and configured and disposed to spray a fluid from said fluid passage at said suction opening; and a spray nozzle selector valve operable to selectively and alternately permit or preclude a flow through said first spray nozzle and concurrently through said one or more second spray nozzles and said one or more third spray nozzles.

25. The apparatus of claim 24, further comprising:

a second spray nozzle selector valve operable to selectively and alternately permit or preclude a flow through said one or more second spray nozzles and said one or more third spray nozzles.

26. The apparatus of claim 22, further comprising:

a sheath slidable mounted and slidable between a lowered position and a raised position;

a cover pivotally attached to said sheath and rotatable between a position where said suction head is covered by said cover and a second position where said suction head is not covered by said cover; and a rack and a pinion engaged with said rack, said pinion being operatively connected to said cover and said sheath such that sliding said sheath causes said pinion to operate against said rack and rotate said cover between the covered and uncovered positions.

27. An apparatus for clearing waste from a surface, comprising:

a vacuum suction head having a suction opening for accepting waste material;

a waste receptacle for storing waste material that are vacuumed through said suction opening, said waste receptacle having a discharge opening through which waste material stored within said waste receptacle may be discharged for emptying said waste receptacle;

a vacuum passage fluidically connecting said suction opening and said waste receptacle;

a reversible vacuum pump in communication with said waste receptacle for alternately providing a vacuum on said waste receptacle and pressurizing said waste receptacle;

a vacuum passage valve disposed across said vacuum passage, said vacuum passage valve operable to alternately permit or preclude a flow through said vacuum passage;

a waste receptacle lid disposed across said discharge opening, said waste receptacle lid rotatably mounted for rotation between a position wherein said discharge opening is sealed by said waste receptacle lid and a second position wherein said discharge opening is open to permit a flow through said discharge port;

a fluid passage configured at one end to be connected to a source of pressurized water by a garden hose;

a first spray nozzle connected to an end of said fluid passage and configured to jet fluid from said fluid passage in a direction away from an operator and against material on the surface; and a control valve disposed across said fluid passage, said control valve operable to alternately permit or preclude a flow through said fluid passage.

28. The apparatus of claim 27, further comprising:

a chemical dispenser for storing a chemical solution, said chemical dispenser fluidically connected to said fluid passage and operating to admix the chemical solution with water flowing through said fluid passage.

29. The apparatus of claim 28, further comprising:

a vacuum passage spray nozzle fluidically connected to said fluid passage and configured and disposed to spray fluid from said fluid passage into said vacuum passage at location intermediate said suction head and said waste collection receptacle; and a vacuum passage spray nozzle valve operable to alternately permit or preclude a flow through said vacuum passage spray nozzle.

30. The apparatus of claim 28, further comprising:

a spray head fluidically connected to said fluid passage and configured and disposed to spray a fluid from said fluid passage within said waste receptacle for flushing the interior thereof; and a spray head valve operable to alternately permit or preclude a flow through said spray head.

31. The apparatus of claim 28, further comprising:

one or more second spray nozzles fluidically connected to said fluid passage and configured and disposed to spray a fluid from said fluid passage on to an exterior surface of said suction head for cleaning debris therefrom;

one or more third spray nozzles fluidically connected to said fluid passage and configured and disposed to spray a fluid from said fluid passage at said suction opening; and a spray nozzle selector valve operable to selectively and alternately permit or preclude a flow through said first spray nozzle and concurrently through said one or more second spray nozzles and said one or more third spray nozzles.

32. The apparatus of claim 31, further comprising:

a second spray nozzle selector valve operable to selectively and alternately permit or preclude a flow through said one or more second spray nozzles and said one or more third spray nozzles.

* * * * *